US010267011B2

(12) United States Patent
Baumgartner et al.

(10) Patent No.: US 10,267,011 B2
(45) **Date of Patent: *Apr. 23, 2019**

(54) PRE-CAST DECORATIVE RETAINING WALL SYSTEM

(71) Applicant: ECO CONCRETE SOLUTIONS, INC., Brighton, CO (US)

(72) Inventors: Russel W. Baumgartner, Rancho Santa Fe, CA (US); Richard K. Taylor, San Diego, CA (US); Lizzy N. Baumgartner, Rancho Santa Fe, CA (US)

(73) Assignee: ECO CONCRETE SOLUTIONS, INC., Brighton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,901

(22) Filed: Aug. 20, 2018

(65) Prior Publication Data

US 2018/0355576 A1 Dec. 13, 2018

Related U.S. Application Data

(63) Continuation-in-part of application No. 14/604,583, filed on Jan. 23, 2015, now Pat. No. 10,053,833.

(51) Int. Cl.
*E02D 29/02* (2006.01)

(52) U.S. Cl.
CPC .. *E02D 29/0266* (2013.01); *E02D 2250/0007* (2013.01); *E02D 2250/0023* (2013.01); *E02D 2300/002* (2013.01)

(58) Field of Classification Search
CPC . E02D 29/02; E02D 29/0266; E02D 29/0275; E02D 29/0283
See application file for complete search history.

(56) References Cited

U.S. PATENT DOCUMENTS 1,356,319 A * 10/1920 Smulski ..... E02D 29/0266 405/286
3,195,312 A * 7/1965 Rumsey, Jr. ..... E02D 29/0266 405/287
4,000,622 A * 1/1977 Chiaves ..... E02D 29/0266 405/286

(Continued)

*Primary Examiner* — Benjamin F Fiorello
(74) *Attorney, Agent, or Firm* — Richard D. Clarke

(57) ABSTRACT

Provided is a pre-cast structural and/or decorative retaining walls, concrete walls that require moment restraints in one or two directions like retaining walls, monuments, levy walls, fences, building walls or any freestanding wall structure consisting of concrete walls constructed on a horizontal surface normally at a manufacturing facility, on rolling platforms or other substrate, or preferably built on the construction site where after curing the pre-fabricated walls can be installed at a site. The pre-cast panels can have a wide variety of decorative elements readily applied to both the upper and lower downside reflection surface. A unique feature is the buttress system that is added to the back of the wall system when elevated retention is required. By placing the buttress portion on top of the footing, and tying into the pre-decorated wall with reinforcement, an eco-friendly, design optional retaining wall system is accomplished which is rapidly and economically installed.

24 Claims, 21 Drawing Sheets

(56) References Cited

U.S. PATENT DOCUMENTS 4,290,246 A * 9/1981 Hilsey ..... E02D 27/02 52/125.3
4,314,775 A * 2/1982 Johnson ..... F16L 1/036 138/105
4,569,173 A * 2/1986 Hultquist ..... E02D 27/01 52/293.1
4,643,618 A * 2/1987 Hilfiker ..... E02D 29/0241 405/284
4,911,585 A * 3/1990 Vidal ..... E02D 29/0283 405/284
4,957,395 A * 9/1990 Nelson ..... E02D 29/0266 405/285
4,993,872 A * 2/1991 Lockwood ..... E01F 5/005 405/125
5,125,765 A * 6/1992 Verble ..... E02B 3/046 405/31
5,131,786 A * 7/1992 House ..... B65D 88/76 404/6
5,308,195 A * 5/1994 Hotek ..... E02D 29/0283 405/284
5,471,811 A * 12/1995 House ..... E01F 8/0011 256/13.1
5,492,438 A * 2/1996 Hilfiker ..... E02D 29/0241 405/285
5,536,113 A * 7/1996 McGregor ..... E01F 5/005 405/125
5,624,615 A * 4/1997 Sandorff ..... B28B 7/0088 264/247
5,697,736 A * 12/1997 Veazey ..... E02D 29/02 405/21
6,243,994 B1 * 6/2001 Bernini ..... E02D 29/045 14/26
6,367,214 B1 * 4/2002 Monachino ..... E02D 27/02 52/247
7,614,830 B1 * 11/2009 Ritke ..... E02D 29/02 405/286
8,425,152 B1 * 4/2013 South ..... E02D 29/05 405/124
8,425,153 B1 * 4/2013 South ..... E02D 29/00 405/124
8,568,057 B2 * 10/2013 Rodriguez ..... E01F 15/088 256/13.1
8,713,871 B2 * 5/2014 Wallin ..... E02D 29/0275 52/250
8,925,282 B2 * 1/2015 Aston ..... E02D 29/045 52/293.1
2003/0143029 A1 * 7/2003 Lockwood ..... E01F 5/005 405/125
2005/0155297 A1 * 7/2005 Aburto Ponce ..... E04B 1/161 52/79.1
2006/0177278 A1 * 8/2006 Carey ..... E01B 2/00 405/285
2009/0232608 A1 * 9/2009 Chouery ..... E02D 29/02 405/287
2011/0211918 A1 * 9/2011 Johnson ..... E04C 1/395 405/286
2014/0270990 A1 * 9/2014 Heraty ..... E02D 29/0266 405/286

* cited by examiner

RETAINING WALL SCHEDULE (2:1 BACKFILL – W/ 4" – 6" HEELS (MAX. )) – CUT

| H | W1 | W2 | W3 | W4 | W5 | d | d1 | b1a | b1b | b2 | b3 | b4 | b5 | h1 |
|---|---|---|---|---|---|---|---|---|---|---|---|---|---|---|
| 0'-0" – 2'- 0" | 2' – 0" | 0 | 6" | 12" | 5 ½" | 12" | 0 | #4@18" | #4@18" | 0 | #4@12" | #4@16" | #4@16" | 15" |
| 2'-1" – 4'-0" | 2' – 0" | 0 | 6" | 12" | 5 ½" | 12" | 0 | #4@18" | #4@18" | 0 | #4@12" | #4@16" | #4@16" | 22" |
| 4'-1" – 6'-0" | 3' – 0" | 0 | 6" | 12" | 5 ½" | 12" | 0 | #4@18" | #4@18" | 0 | #4@12" | #4@16" | #4@16" | 24" |
| 6'-1" – 8'-0" | 5' – 6" | 12" | 1'-3" | 12" | 5 ½" | 16" | 4" | #6@16" | #6@16" | #6@18" | #4@12" | #4@8" | #4@16" @2'-6" | 2' – 9" |
| 8'-1" – 10'-0" | 6' – 6" | 12" | 2'-0" | 12" | 5 ½" | 16" | 10" | #6@10" | #6@10" | #6@18" | #4@12" | #4@8" | #4@16" @4'-3" | 3' – 9" |
| 8'-1" – 10'-0" | 6' – 6" | 12" | 2'-0" | 12" | 7 ¼" | 16" | 10" | #6@10" | #6@10" | #6@18" | #4@12" | #5@8" | #44@16" @4'-3" | 3' – 9" |
| 10'-1" – 12'-0" | 6' – 9" | 12" | 3'-3" | 15" | 7 ¼" | 18" | 18" | #7@11" | #7@11" | #6@16" OR #7@22" | #4@12" | #5@8" | #5@16" @5'-0" | 4' – 9" |
| 12'-1" – 14'-0" | 9' – 3" | 12" | 4'-9" | 17" | 7 ¼" | 18" | 23" | #7@8" | #7@16" @30" | #6@16" | #4@12" 2 ROWS | #6@9" | #6@16" 5'-0" | 6' – 6" |
| 14'-1" – 16'-0" | 11' – 0" | 19" | 6'-6" | 20" | 9 ¼" | 21" | 26" | #8@8" | #8@16" @40" | #6@16" | #4@12" 2 ROWS | #6@8" | #6@16" @6'-3" | 7' – 0" |
| 14'-1" – 16'-0" | 11' – 0" | 19" | 6'-6" | 20" | 7 ¼" | 21" | 26" | #8@8" | #8@16" @40" | #6@16" | #4@12" 2ROWS | #6@8" | #6@16" @4'-9" | 8' – 6" |

H = height of retaining W1 = total footing width W2 = width of key W3 = length of footing toe W4 = width of buttress W5 = width of pre-cast panel d = footing thickness d1 = depth of key b1a = buttress base reinforcement b1b = buttress top reinforcement b2 = top of footing reinforcement b3 = connector size/spacing tension tie bar b4 = bottom of panel reinforcing b5 = top of pre-cast penal reinforcing h1 = true effective buttress height

FIG. 22

TABLE 1

PRE-CAST DECORATIVE RETAINING WALL SYSTEM

FIELD OF THE INVENTION

The present invention provides a process for constructing concrete walls that require moment restraints in one or two directions like retaining walls, monuments, levy walls, fences or building walls, or any freestanding wall structure. More particularly, the present invention provides a process for constructing concrete retaining walls at a remote location using pre-fabricated wall panels with a unique variety of design and decoration capabilities the customer can create, and then have transported to the building site, or be pre-fabricated on the building site, to be installed as a retaining wall using a specially designed footing and buttress support system if required, or as a monument wall or fence.

BACKGROUND OF THE INVENTION

Pre-cast tilt-up, cast on site or off site, (also known as Pre-cast tilt-slab or tilt-wall) concrete construction is not new and has been in use since the turn of the century. Since the mid-1940s it has developed into the preferred method of construction for many types of buildings and structures in the U.S. Pre-cast concrete construction has many advantages that are well known in the art. The Pre-cast concrete panels can significantly reduce the initial cost of construction and provide a relatively low-cost, low-maintenance structure. Depending on the size and type of application, such Pre-cast panels can be fabricated and stored offsite then delivered just in time for installation. They can also be constructed by prefabricating the walls on the construction site thereby eliminating relatively expensive transportation costs (pre-fabrication on site).

After concrete footings and a concrete slab or any level base have been poured and properly cured, or a level casting bed (or any other level substrate) has been constructed, a Pre-cast tilt-up concrete structural panels can be formed on the concrete slab. In tilt-up concrete construction, vertical concrete elements, such as walls, columns, structural supports, and the like, are formed horizontally on a concrete slab; usually the building floor, but sometimes on a temporary concrete casting. After the concrete has cured, the elements are tilted from horizontal to vertical with a crane and braced into position until the remaining building, structural components are secured. In the same way, the Pre-cast concrete panels can be formed in an offsite location, or on site location, using various types of forms well known in the art. After curing, the Pre-cast and cured panels are transported to the building site and installed by means and methods well known in the art.

Construction of a Pre-cast concrete wall panel is begun by carefully planning out the size and shape of the wall panel on a suitable surface, such as the concrete slab, or any other level substrate (i.e., floor) of the building being constructed. A form release agent and bond breaker is then applied to the concrete slab and to panel forms in accordance with manufacturer recommendation.

After the form is constructed, a grid of steel rebar is constructed and tied in-place within the form to reinforce the structural panel. Plastic or metal support chairs are used to support the rebar grid at a proper depth. Inserts provide attachment points for lifting hardware and temporary braces.

Before concrete is placed in the form, the slab or casting surface must be cleaned, and a release bond breaking agent is applied to prevent the panel from bonding to the casting surface. Regardless of the type of bond breaking agent used, there is always a certain amount of bond formed between the Pre-cast panel and the casting surface that must be broken before the panels will separate from the casting surface. Additional steel reinforcement is factored in so that the concrete panels can be lifted in place without damage. Concrete is then placed in the form in the same manner as floor slabs. The concrete is usually consolidated to ensure good flow around die steel rebar grid. Then, the concrete surface can be finished in any desired manner, such as trowel finish or other types of architectural finishes and patterns. On optional level substrates, the down side reflective surface can also be made decorative with types of artistic finishes and patterns.

Numerous innovations for the wall systems have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Pre-cast Decorative Retaining Wall System and the prior art.

U.S. Pat. No. 4,031,684 of Tokuhito Shibata describes a decorative Pre-cast concrete boards having a pore-free decorative porcelain-tile-like, hewn-stone-like or relief surface and a porous core layer are provided. Such Pre-cast concrete boards are produced by applying inorganic cement mortar containing siliceous volcanic sand called "shirasu" in a flat mold made of an elastomeric material so as to form the pore-free surface and pouring thereon an inorganic concrete mortar containing expanded particles of said siliceous sand as the aggregate. The concrete boards do not stiffer efflorescence.

This patent describes decorative Pre-cast concrete'boards having a pore-free decorative porcelain-tile-like, hewn-stone-like or relief surface and a porous core layer. Although this patent does describe decorative features it does not describe the unique back lighted tesserae components or the unique buttress support feature for constructing higher retaining walls.

U.S. Pat. No. 5,624,615 of Daniel R. Sandorff describes a modular stone panels which simulate assembled masonry, and are useful for decorative walls, retaining walls, facings for structures and the like. Pre-cast stone-faced panels are made by setting stones such as field stone having at least one relatively flat face, substantially directly on the bottom of a rectangular mold. The stones are set in the mold individually while packing sand around and between the stones but not under them. This is done by sliding each stone laterally across the bottom of the mold, thereby packing the sand while substantially keeping the stones supported immovably against the bottom. The stones do not float on a sand bed and the sand between them is packed. Thus the stone and sand are less readily displaced by concrete poured over them during vibration, causing a liquid portion of the concrete to diffuse into the sand. Retaining rods are carried on coil threaded rods that, are removed to provide either points of attachment for mounting or lifting, or as weep holes. The retaining rods can extend into edge cavities and preferably into tubular receptacles, filled with concrete to lock joints between adjacent panels. For making corners, alternating stones protrude from the concrete in a first cast panel, and are interleaved with stones when casting a next panel so as to extend around the corner in lieu of a solid concrete strip. The stone facing can extend over only a part of the panel height, particularly for retaining walls, which can be passively braced using the threaded point of attachment and a buried anchor such as an automobile tire.

This patent describes decorative walls, retaining walls, facings for structures and the like done, by sliding each stone laterally across the bottom of the mold, thereby packing the sand while substantially keeping the stones supported immovably against the bottom. This patent does not describe the unique back lighted tesserae components or the buttress support feature. It also does not describe the use of the decorative walls in a smaller scale to be used as monument walls of quickly assembled fencing material.

U.S. Pat. No. 8,555,584 of Romeo Ilarian Ciuperca describes a method of forming a concrete structure. The method comprises placing plastic concrete in a form of a desired shape, encasing the concrete in insulating material having insulating properties equivalent to at least 1 inch of expanded polystyrene and allowing the plastic concrete to at least partially cure inside the insulating material. An insulated concrete form and a method of using the insulated concrete form are also disclosed.

This patent describes a method that comprises placing plastic concrete in a form of a desired shape, encasing the concrete in insulating material. This patent does not describe the buttress support features of this application along with the elevated decorative features. It also does not describe the use of the decorative walls in a smaller scale to be used as monument walls or quickly assembled fencing material.

U.S. Pat. No. 6,808,667 of Peter Anthony Nasdvik et al. describes a contoured wall and method is disclosed for creating the contour and appearance of a wall formed from individual assembled units such as stones. The wall is formed from a plurality of mating form liners each having a reciprocal contoured surface to that of the desired stone wall. The wall is formed from hardenable construction material such as concrete poured between two mold members with the form liners attached to at least one of the mold members. Each of the form liners has a lateral relief mold face adapted to provide a molded surface having the contour of a stone wall. Each lateral relief mold face of the form liners has a latticework non-linear mortar-forming interlocking portion surrounding stone-forming recessed portions. The form liners are posinonable in a plurality of arrangements wherein the interlocking portions and recessed portions along the mating edge of each form liner mate along mating edge of the adjacent form liner to form a continuous lateral relief mold face.

This patent describes a contoured wall and method for creating the contour and appearance of a wall formed from individual assembled units such as stones. Although this patent does describe decorative features it does not describe the wide variety of features including the unique back lighted tesserae components or the unique buttress support feature.

None of these previous efforts, however, provides the benefits attendant with the Pre-cast Decorative Retaining Wall System. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the Pre-cast Decorative Retaining Wall System in detail it is to be understood that the, design is not limited in its application to the details of construction and to the arrangement, of the components set forth in the following description or illustrated in the drawings. The Pre-cast Decorative Retaining Wall System is capable of other embodiments and of being practiced and carried out in various ways. In addition, it is to be understood that the phraseology and terminology employed herein are for the purpose of description and should not be regarded as limiting. As such, those skilled in the art will appreciate that the conception, which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application. A retaining wall is defined as any wall which resists forces from any source or medium, including but not limited to wind, seismic, water, grains, soils and soil surcharges. The present invention provides for a process that creates a concrete mechanism, namely, a buttress support structure, that can connect two separate components, a wall and a footing, in a fashion that allows for restraint in two opposite directions as well as vertically and horizontally.

SUMMARY OF THE INVENTION

The principal advantage of the Pre-cast Decorative Retaining Wall is that it can be manufactured at a factory and transported to a building site, or be prefabricated or manufactured on the final installation or building site.

Another advantage of the Pre-east Decorative Retaining Wall is that numerous unique buttress support systems may to be used for installing elevated retaining walls.

Another advantage of the Pre-cast Decorative Retaining Wall is the way that the rebar in the wall is connected to the rebar in the buttress support system to elevate the bending moment of the wall.

Another advantage of the Pre-cast Decorative Wall is that it can incorporate tesserae or other transparent imbedded materials that can be back lit by various lighting means including fiber optics prior to delivery.

Another advantage of the Pre-cast Decorative Retaining Wall is that it can incorporate a variety of through wall water, electrical or gas features before delivery.

Another advantage of the Pre-cast Decorative Retaining Wall is it can be capped with electrical outlets and various electrical lighting features, gas or propane torches or attachments for Christmas decorations prior to delivery.

Another advantage of the Pre-cast Decorative Retaining Wall is a customer has the capability of choosing from a wide variety of decorative computer generated design features.

Another advantage of the Pre-cast Decorative Retaining Wall is a customer has the capability of directing and creating their own design features prior to delivery, or while the wall patterns are prefabricated on site.

Another advantage of the Pre-cast Decorative Retaining Wall is the design features can be projected down during the manufacturing process by the means of an overhead projector to create the exact repeating patterns on both surfaces if desired.

Another advantage of the Pre-cast Decorative Retaining Wall is Styrofoam inserts can be inset into the form to create decorative openings through the wall.

Yet another advantage of the Pre-cast Decorative Retaining Wall in a smaller scale can be used as memorial walls and many types of decorative fencing.

And another advantage of the Pre-cast Decorative Retaining Wall is that it is an eco-friendly system in that the walls are constructed horizontally, and the formwork lumber is limited to the thickness of the wall, unlike cast in place where substantially more lumber, in the form of 2×4's and plywood, is required.

Yet another advantage of the Pre-cast Decorative Retaining Wall System is the variety of design options since the walls are constructed horizontally they can be decorated using techniques that are reserved only for flatwork, including polished, stamped, seeded and mosaic elements, and since the walls are cast on a surface, the concrete will pick up the reflection of that surface and make unique impressions, that is a form liner, or any other materials used to create a mold, onto the wall that will be seen when the wall is erected vertically.

And another advantage of die Pre-cast Decorative Retaining Wall System is increased safety at the construction site in that since the wall is constructed horizontally it makes the use of scaffolding unnecessary, which eliminates having to work off the ground, making them safer to build (additionally high pressures within the framework is eliminated).

And another advantage of the Pre-cast Decorative Retaining Wall System is speed, since the walls are built independent of the footings (unlike a masonry wall) the walls can be built before the footing is complete, the completed and cured walls can be stood on the footings within hours, and the buttress is poured immediately after and upon reaching 2500 psi, so within 24-48 hours it can be backfilled.

These together with other advantages of the Pre-cast Decorative Retaining Wall along with the various features of novelty, which characterize the design, are pointed out with particularity in the following summary of this application.

The Pre-cast Decorative Retaining Wall consists of concrete walls constructed on a horizontal surface normally at a manufacturing facility, preferably on rolling platforms, or at the building site. At the building site, footing preparation is made by compaction of the soil and forming the footing with the size and rebar reinforcing requited by the height and dimensions of the wall. After the concrete has been placed for the footings and the prescribed period of time has passed the walls can be erected.

For retaining walls, or any wall structure, a unique buttress support system has been designed where reinforcement elements, such as rebar extending from the back of the wall is attached, via the concrete buttress, to rebar reinforcing that is left exposed from the footing on the back side of the wall where the buttress support system will be placed after the wall has been erected. The height of this attachment changes the moment arm about which the wall rotates from the bottom of the wall to the elevation of the attachment points. This attachment to the wall can be made by various methods, one being the rebar extending out of the back of the wall and bent parallel to the wall surface during construction. An additional method will be having commercially available anchoring systems such as the Richmond dowels (or other rebar type coupling devices) to anchor the rebar in the wall to the rebar in the buttress support section of concrete. By elevating the attachment points and the size of the buttress support system the pre-cast and overall wall height may be extended safely.

For the basic undecorated wall system the wall forms will be setup over a release agent on a platform, or cast on the appropriate medium. Miscellaneous hardware, lift inserts, weld plates and reinforcing rebar will be inserted within the forms.

A specified mixture of concrete (in some cases waterproofed) will be poured into the forms and vibrated. The surface will be screed and trowel finished with an applicable retarder if required. After a minimum 3000 psi is attained, the panels are generally available to be transported and/or erected onto the construction site.

The decorative panel preparation consists of concrete walls constructed on a horizontal surface normally at a manufacturing facility, preferably on rolling platforms, or on site. The surface of the platform will either have a layer of emulsified sand, a form liner or Styrofoam, or other three dimensional relief materials or decorations, beneath the forms before they are put in place. Miscellaneous hardware, lift inserts, weld-plates and reinforcing rebar will be inserted within the forms.

In one process a decorative pattern can be generated, or the customer can create their own design pattern for the wall. The pattern is then projected down to the platform surface by the means of an overhead projector to create the exact repeating pattern for both front and back surfaces if desired. The decorative patterns for the back of the wall will be projected on the surface material on the rolling platform and the decorative patterns for the front will be projected on the concrete surface after it has been inserted into the wall forms. Additional Styrofoam or other materials shapes can be cut to be located on the surface and then removed after the concrete is cured to create design shapes through the wall. Reinforcing and accessory decorative components will be inset so as not to interfere with the decorative features on either side.

Additional design features will include tesserae or other transparent materials imbedded in to the surface of the concrete to be back lit by various lighting means including fiber optics. Plastic sleeves or removable cores are temporally affixed to the back of the tesserae Or other transparent materials to be removed after the concrete has cured as a means to connect the lighting elements. Reinforcing and accessory decorative components will be inset so as not to interfere with the decorative features on either side.

Another design feature will have electrical, gas or plumbing conduits and components imbedded in, through or on the surfaces of the wall prior to the placement of the concrete. In all cases the proprietary concrete mix will be placed in a manner so as not to disturb the inlayed decorative features.

After the concrete surface reaches the desired strength the forms will be stripped, and the surface washed by a certified Enhanced Concrete Systems (ECS) technician to achieve the predetermined effect as required. An applicable curing compound will be applied if required on all surfaces. After 3000 psi is achieved on the off site or on site wall casting, the resulting wall panels can be erected or, if off site prefabrication is employed, moved to the construction site and then erected. The wall panels will be power washed, and acid etched if required. An additional densifying sealer can then be applied to all exposed surfaces, as required.

As the wall panels are erected and supported in place they will be shimmed if required to establish specified elevation, the required buttress support system will be placed at the back of the panels. A wide variety of conventional water proofing materials and drainage methods will be used on the back sides of the walls and buttress support system depending on the ground conditions, the height of the material retained and the height of the wall. Alternatively, the walls can be constructed utilizing a waterproofing admixture in the specified mix design.

An alternate embodiment of the Pre-cast Decorative Retaining Wall will be the Pre-cast Monument Wall or Pre-cast Concrete Fencing where concrete walls will be constructed on a horizontal surface normally at a manufacturing facility, preferably on the building site (on site), or on rolling platforms. Both sides of the fence wall can be decorated by utilizing the techniques described above for the reflection side (downside during casting) and the upside surfaces. These will be similar to the basic undecorated wall system or the decorative panel but will sit on a series of Pre-cast footing blocks having a slot to retain the wall segments or attached to an existing concrete surface, or upon conventional, footings in the same configuration as the pre-cast wall panels.

With respect to the above description then, it is to be realized that the optimum dimensional relationships for the pans of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Pre-cast Decorative Retaining Wall System. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Pre-cast Decorative Retaining Wall and together with the description, serve to explain the principles of this application.

FIG. 22 depicts TABLE 1 including the various retaining wall schedule showing the various specification length, width, thickness, and height of the components of the wall for constructing walls of varying height, thickness and length per moment restraint specifications for a retaining wall 2:1 backfill with 4" to 6" heels maximum-cut.

DETAILED DESCRIPTION OF THE PREFERRED EMBODIMENTS

Figures 1A, 1B:
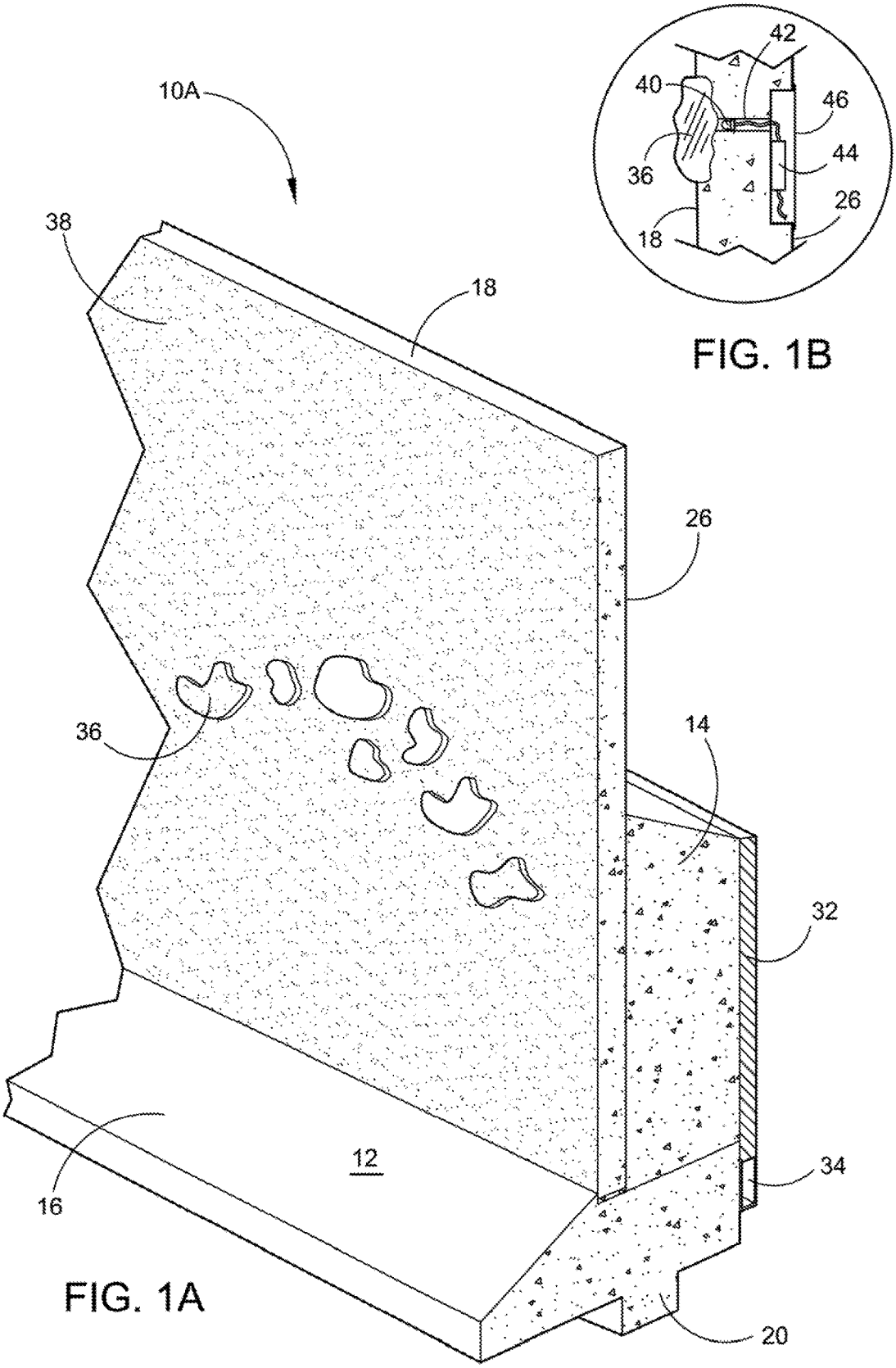
FIG. 1A depicts a perspective section view of the Pre-cast Decorative Retaining Wall on a footing with the buttress support.
FIG. 1B depicts a section through the Pre-east Decorative Retaining Wall illustrating a transparent tesserae segment with a LED light wired through an orifice in the wall connected to an electronic control box embedded in the back side of the wall, or can be attached to the back side of the wall.

Referring now to the drawings, wherein similar parts of the Pre-cast Decorative Retaining Wall 10A, 10B and 10C are identified by like reference numerals, there is seen in FIG. 1A a perspective section view of the Pre-cast Decorative Retaining Wall 10A on a footing 12 with the buttress support 14. The footing 12 will have a toe section 16 in front of the wall 18 and a footing key 20 on the lower surface. Conventional waterproofing coatings will be applied to the wall back side 26 of the wall 18 and a water transmitting material 32 with a drainage cavity 34 at the bottom on the back side of the buttress support 14. Alternatively, a waterproofing agent may be added to the concrete mix with only a drainage system required. A tesserae 36 wall design is illustrated on the front wall surface 38 of the wall 18. It should be understood that when constructed, the pre-cast wall may be readily decorated on either the front wall surface 38 or the wall back side 26 as desired. Throughout this description, "placed" or "poured" will be defined as supplying wet concrete to a specific location within specific forms to dry and cure. This can include formed cast, poured, shoveled, pumped, shot ("shotcrete"), dropped, etc.

FIG. 1B depicts a section through the Pre-cast Decorative Retaining Wall 10A illustrating a transparent tesserae 36 segment with a LED light 40 wired through an orifice 42 in the wall 18 connected to junction box 44 and an electronic control panel 46 embedded, or installed later, in the wall back, side 26.

Figure 2:
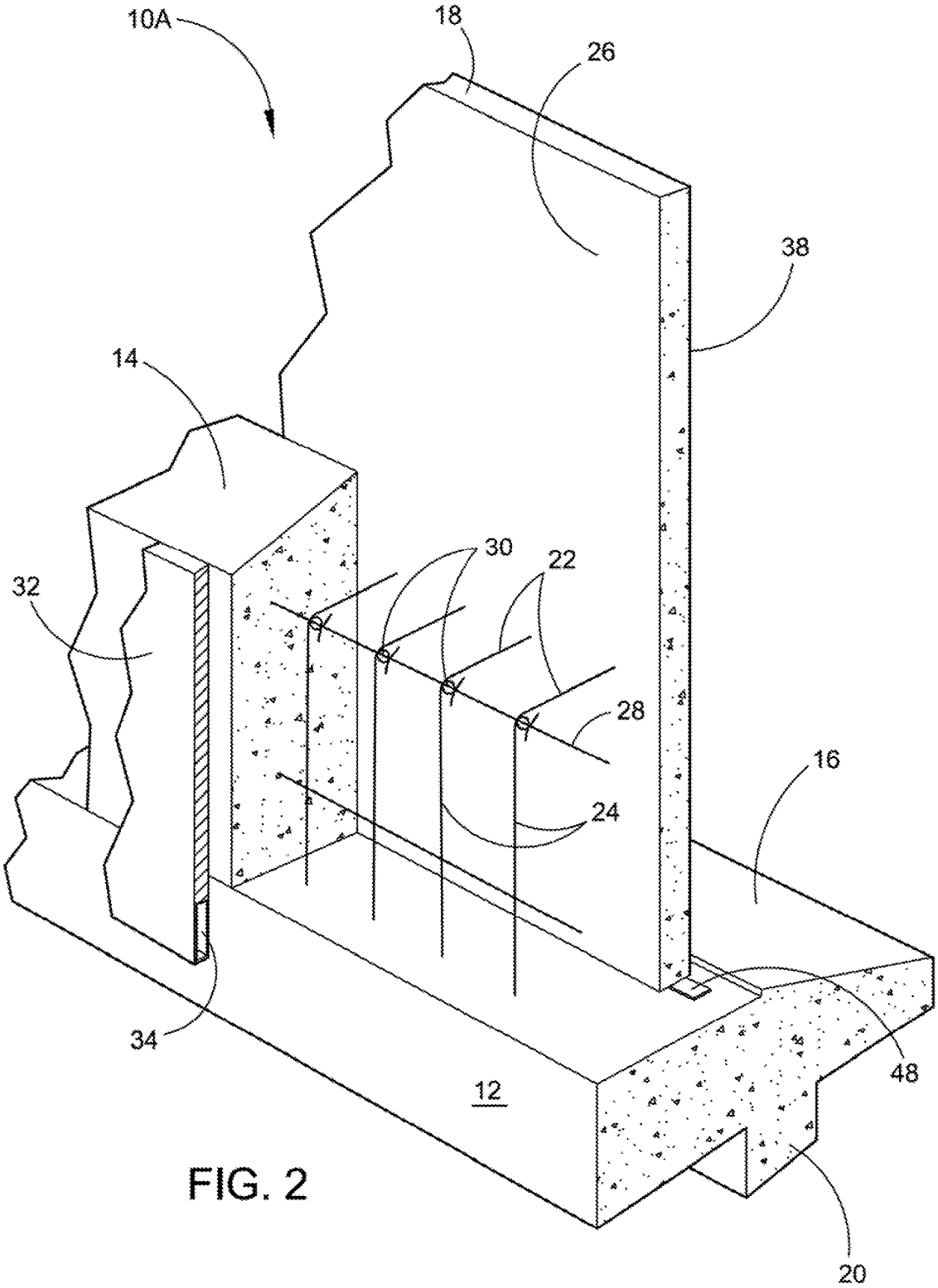
FIG. 2 depicts a perspective view of the back of the Pre-cast Decorative Retaining Wall illustrating the rebar reinforcing between the footing, buttress, and the back of the wall.

FIG. 2 depicts a perspective view of the back of the Pre-cast Decorative Retaining Wall 10A illustrating the reinforcement bar (hereafter "rebar") reinforcing pattern between the footing 12 and the rebar extending from the wall back side 26. Rebar 24, a breakout bar, is left exposed at the rear of the wall to be lapped connected to rebar 22 extending from the footing 12. Horizontal rebar 28 in the buttress support 14 will extend through the overlapping connection 30 of the rebar 22 exposed at the rear of the footing 12 and the rebar 24 extending from the back side 26 of the wall 18. Shims 48, if required, are inserted to level each wall 18 segment prior to pouring the buttress support 14. A retaining wall can be considered any wall which is designed and constructed to resist applied forces from any source or medium, including wind forces, seismic forces, soils, grains, liquids, etc.

Figures 3A, 3B, 3C:
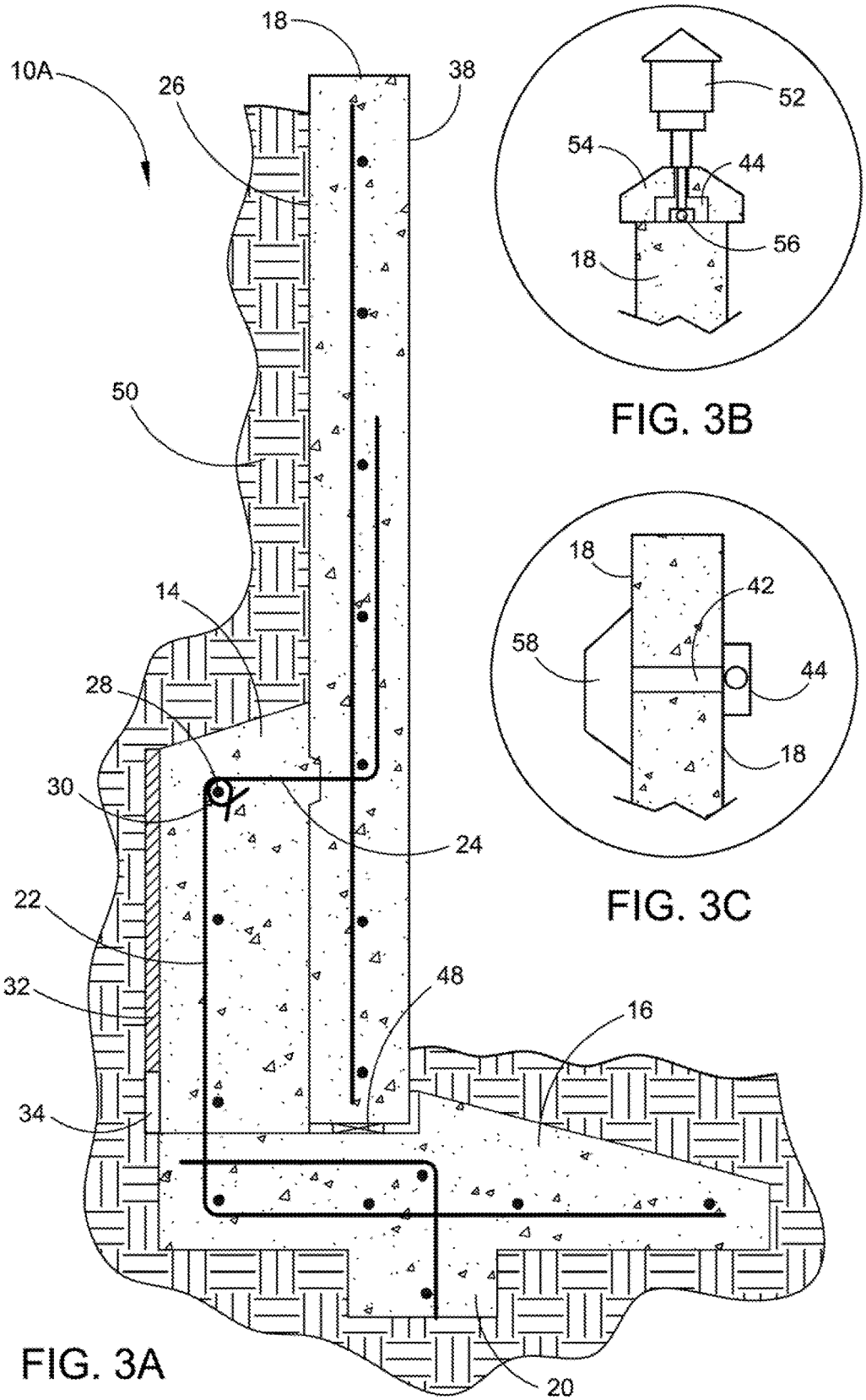
FIG. 3A depicts a cross section through the Pre-cast Decorative Retaining Wall illustrating the connection between the rebar coming from the back of the wall to the reinforcing element, here shown as conventional rebar, in the footing.
FIG. 3B depicts a cross section through the top of the Pre-cast Decorative Retaining Wall with an electric light on top of a wall cap with the electrical conduit running through it.
FIG. 3C depicts a cross section through the top of the Pre-cast Decorative Retaining Wall with an electric light within or on the front face of the wall with the electrical connection running through an orifice in the wall to an electrical connection box on the back of the wall.

FIG. 3A depicts a cross section through the Pre-cast Decorative Retaining Wall 10A illustrating the lap connection between the rebar 24 coming from the back of the wall to the rebar 22 in the footing. Back fill material 50 extends to the top of the wall 18.

FIG. 3B depicts a cross section through the top of the Pre-east Decorative Retaining Wall 10A with an electric light (or gas fixture) 52 on top of a wall cap 54 with the electrical conduit (or gas piping) 56 running through it.

FIG. 3C depicts a cross section through the top of the Pre-cast Decorative Retaining Wall 10A with a wall mount electric light 58 on the front face of the wall 18 with the electrical connection running through an orifice 42 in the wall 18 to an electrical junction box 44 on the wall back side 26. An option is to have a gas fixture utilizing the piping, orifice and gas fixture feature, in place of the electrical set-up shown here.

Figure 4A:
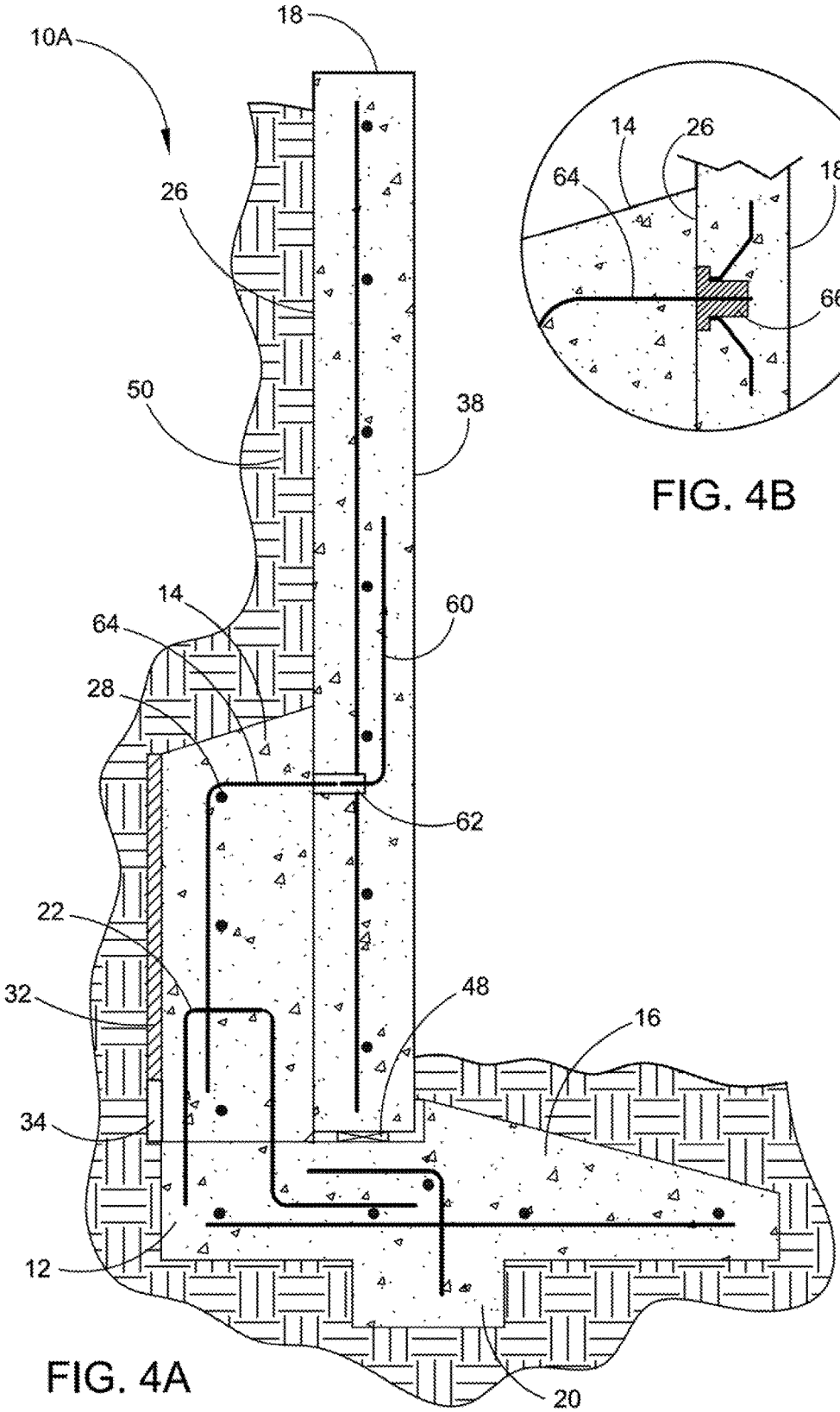
FIG. 4A depicts a cross section through the Pre-cast Decorative Retaining Wall illustrating the connection between the rebar coming from a Richmond Dowel type of concrete anchoring system in the back of the wall to the rebar in the buttress, with buttress bars then going to the footing.

FIG. 4A depicts a cross section through the Pre-cast Decorative Retaining Wall 10A illustrating the connection between the rebar 60 on the inside of the wall 18 to the imbedded Richmond Dowel 62 or other splicing/coupling device or any other type of concrete anchoring system in the wall back side 26. Prior to pouring the concrete for the buttress system 14 rebar 64 extends over and around horizontal rebar 28 and down to be connected to the rebar 22 left exposed at the rear of the footing 12. Throughout this description, reinforcing or reinforcement will be defined as any reinforcement element, typically including conventional steel reinforcement (rebar) but can be any other material or mechanism which provides greater tensile capacity for concrete, whether in the form of rods, strands, fibers or additive form, etc.

Figure 4B:
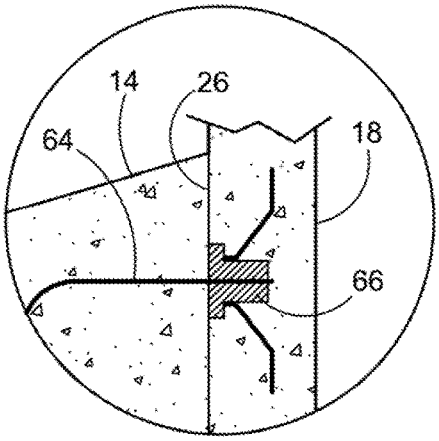
FIG. 4B depicts a cross section through the Pre-cast Decorative Retaining Wall illustrating the connection between the rebar coining from an additional type of concrete anchoring system in the back of the wall to the rebar in the buttress, with buttress bars then going to the footing.

FIG. 4B depicts a cross section through the Pre-east Decorative Retaining Wall 10A illustrating the connection between the rebar 64 coming from an additional type of concrete anchoring system 66 in the wall back side 26 to the rebar 22 in the footing.

Figure 5:
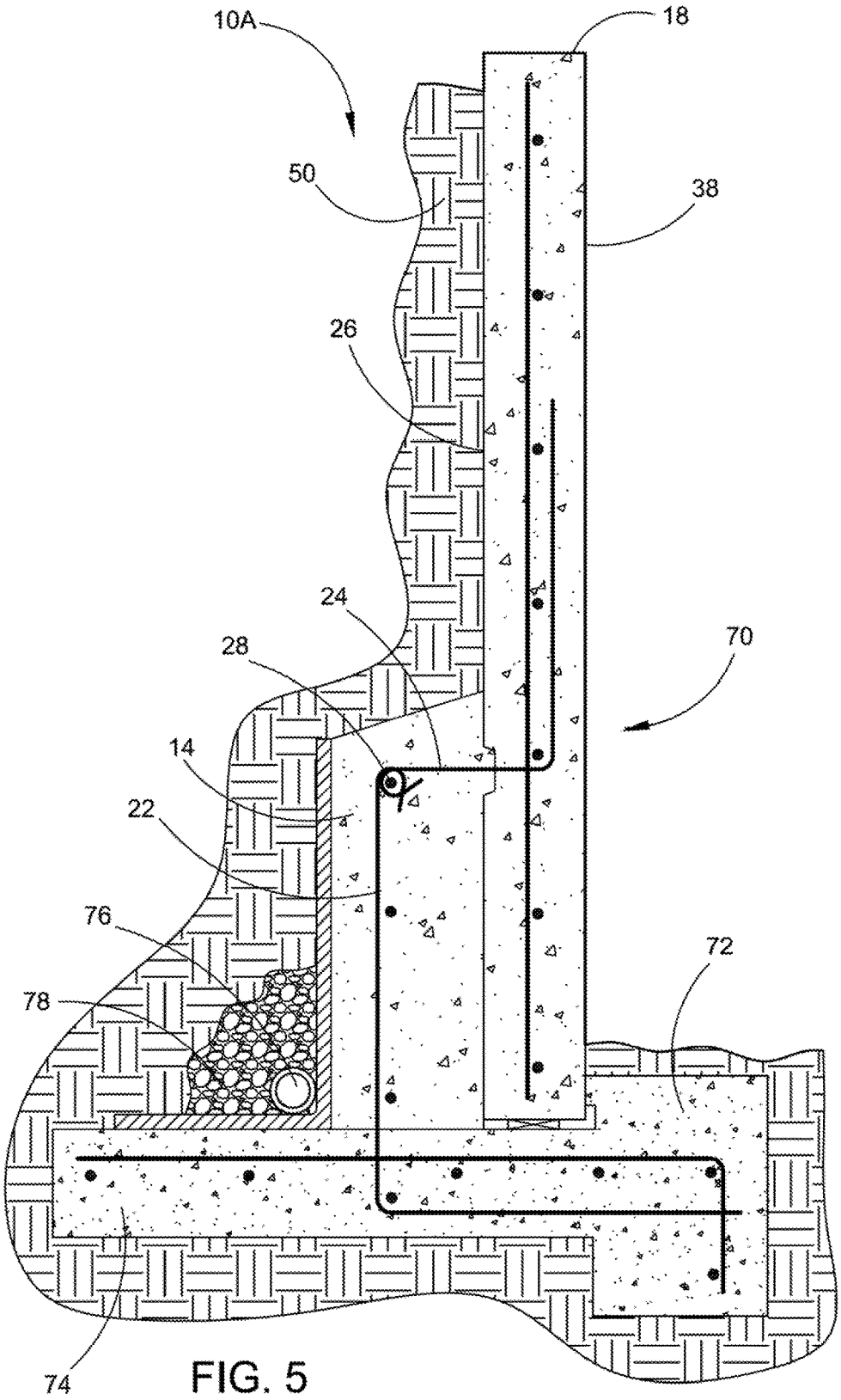
FIG. 5 depicts a cross section through the Pre-cast Decorative Retaining Wall illustrating a different style of footing with a shorter toe and an extended back section having a drain line with a gravel covering.

FIG. 5 depicts a cross section through the Pre-east Decorative Retaining Wall 10A illustrating a different style of footing 70 with a shorter toe 72 and an extended footing back section 74 having a drain line 76 with a gravel covering 78.

Figure 6:
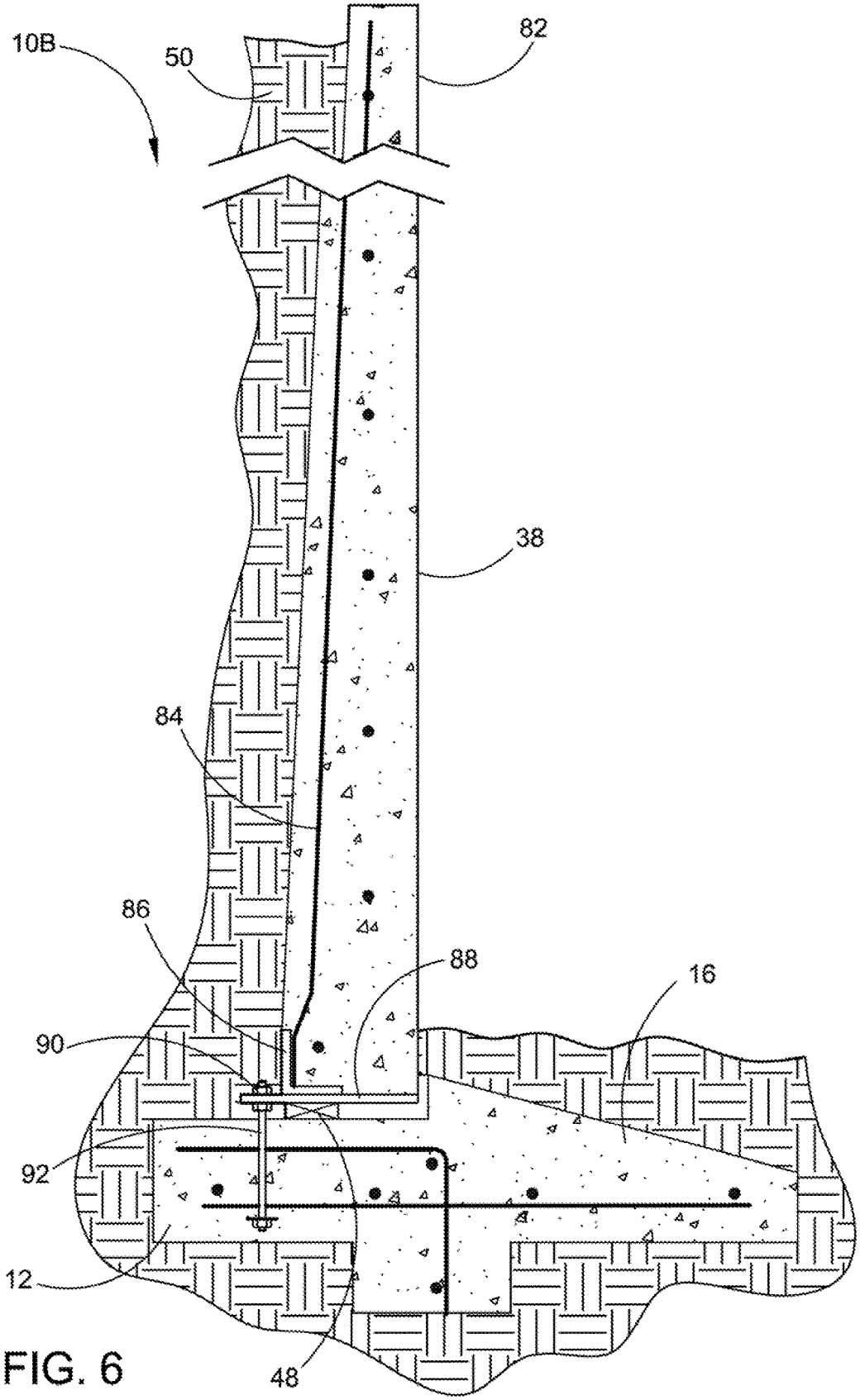
FIG. 6 depicts a cross section through the Pre-cast Decorative Retaining Wall illustrating a tapered wall anchored to the footing without the buttress support system, though the buttress system can be utilized with a tapered wall.

FIG. 6 depicts a cross section through the Pre-cast Decorative Retaining Tapered Wall 10B illustrating a tapered wall 82 anchored to the footing 12 without the buttress support system 14. The tapered wall 82 is anchored to the footing 12 by the means of the wall internal rebar 84 welded to a steel angle 86 and a jacking plate 88 running the length of the tapered wall 82. Jacking nuts 90 on a threaded rod (or threaded bent rebar) 92 will establish the vertical aspect of the tapered wall 82 and shims 48 will establish the level position.

Figure 7A:
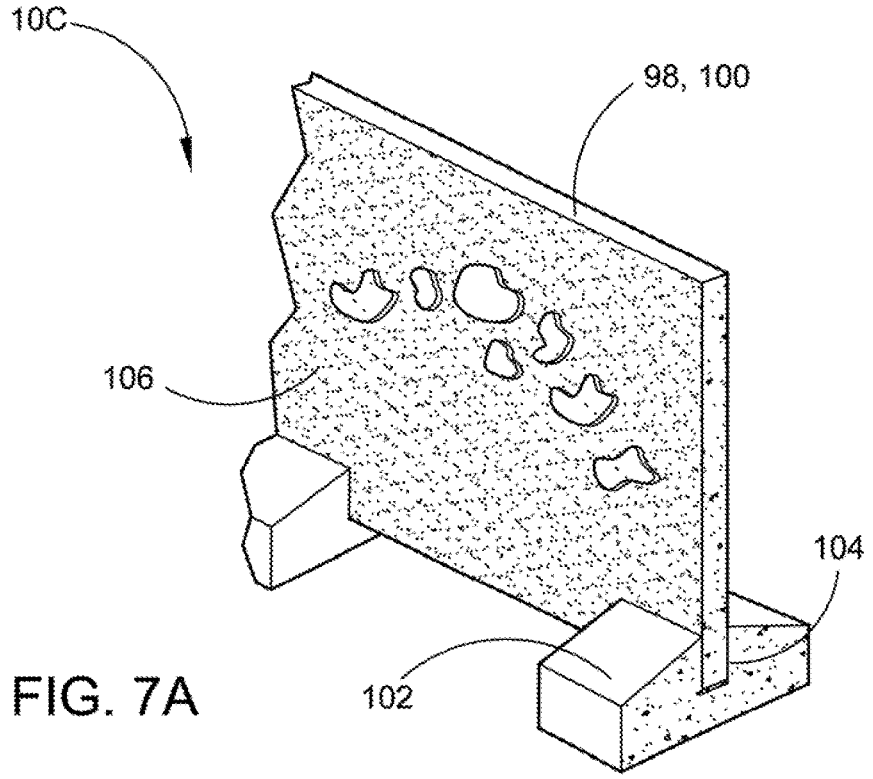
FIG. 7A depicts a perspective view of the Pre-cast Decorative Retaining Wall in the form of Pre-cast, or cast in place Monument Wall or Pre-cast, or cast in place Concrete Fencing (a non-retaining wall configuration) resting on numerous separate individual spaced-apart Pre-cast, or east in place footing blocks each having slots to accept and retain the wall segments.

FIG. 7A depicts a perspective view of a short Pre-cast Decorative Non-Retaining Wall 10C in the form of Pre-cast, or cast in place Monument Wall 98 or Pre-cast Concrete Fencing 100 resting on Pre-cast, or cast in place footing blocks 102 having a wall slot 104 to retain the decorative wall segment 106.

Figure 7B:
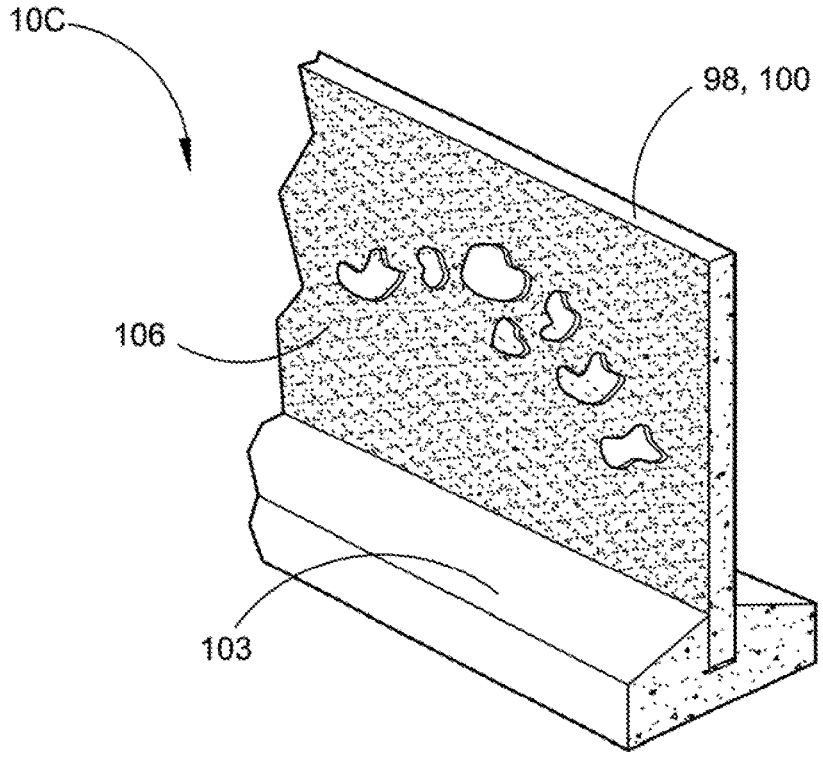
FIG. 7B depicts a perspective view of the Pre-cast Decorative Retaining Wall in the form of Pre-cast, or Cast in place Monument Wall or Pre-cast, or cast in place Concrete Fencing (a non-retaining wall configuration) resting on a continuous Pre-cast, or cast in place footing block having a continuous slot to retain the wall segments.

FIG. 7B depicts a perspective view of the Pre-cast Decorative Non-Retaining Wall 10C in the form of Pre-cast Monument Wall or Pre-cast Concrete Fencing resting on a continuous Pre-cast, or cast in place footing block 103 having a continuous slot to retain the wall segments.

Figure 8:
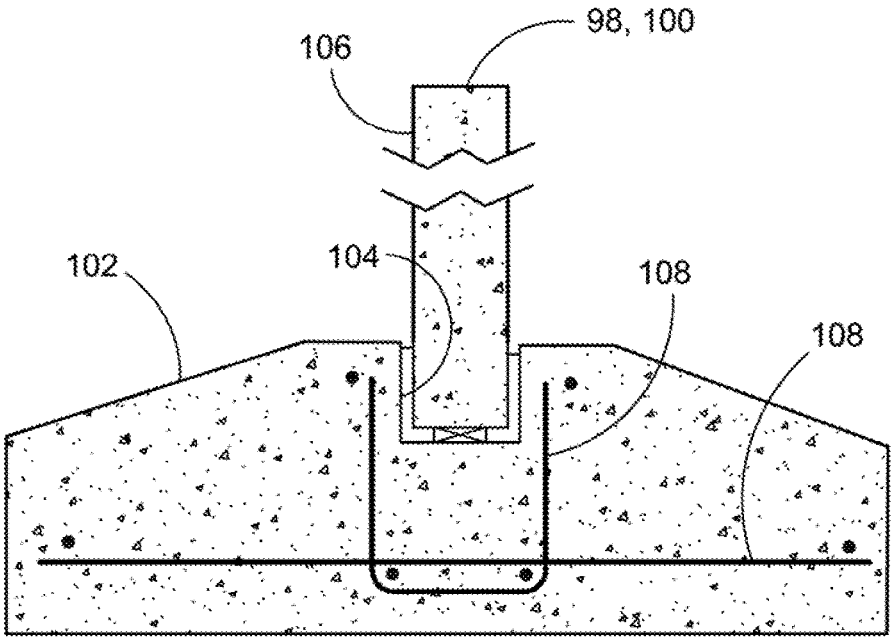
FIG. 8 depicts a cross section through the Pre-cast Decorative Non-Retaining Wall in the for of Pre-cast, or cast in place Monument Wall or Pre-cast, or cast in place Concrete Fencing resting on Pre-cast, or cast in place footing blocks having a slots to retain the wall segments along with the rebar reinforcing members.

FIG. 8 depicts a cross section through a of Pre-cast Decorative Non-Retaining Wall 10C in the form of Pre-cast, or cast in place Monument Wall 98 or Pre-cast Concrete Fencing 100 resting on Pre-cast, or cast in place footing blocks 102 having a wall 104 slot to retain the wall segments 106 along with the rebar reinforcing members 108.

Figure 9:
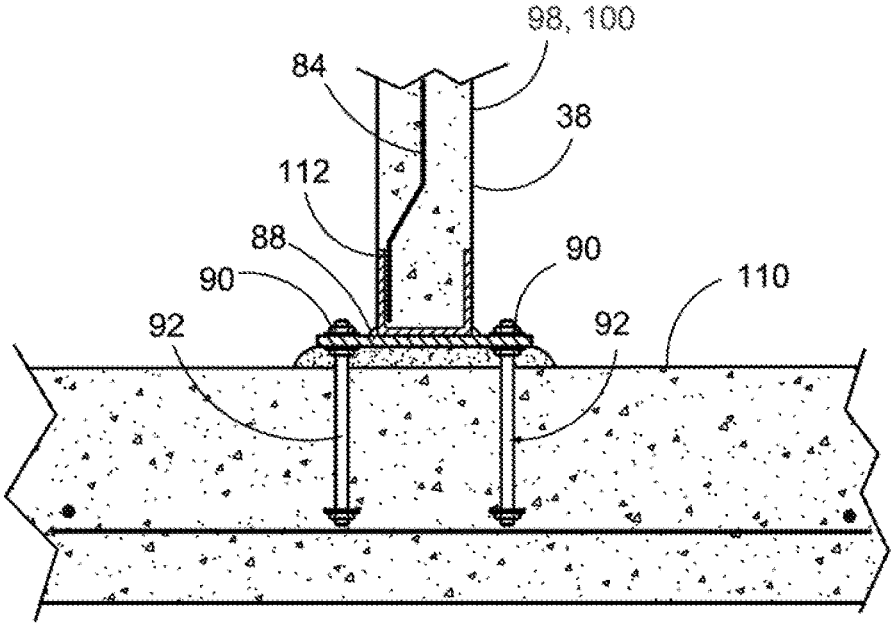
FIG. 9 depicts a cross section through a short portion of the Pre-cast Decorative Retaining Wall with steel angle or channel inserted into the bottom of the wall conventionally anchored to a concrete support.

FIG. 9 depicts a cross section through a short use of the Pre-cast Decorative Retaining Wall 10C with the wall internal rebar 84 welded to the steel angle or channel 112 welded to the jacking plate 88. Jacking nuts 90 on a threaded rod 92 will establish the vertical aspect of the tapered wall 98, 100 conventionally anchored to a concrete slab.

Figure 10A:
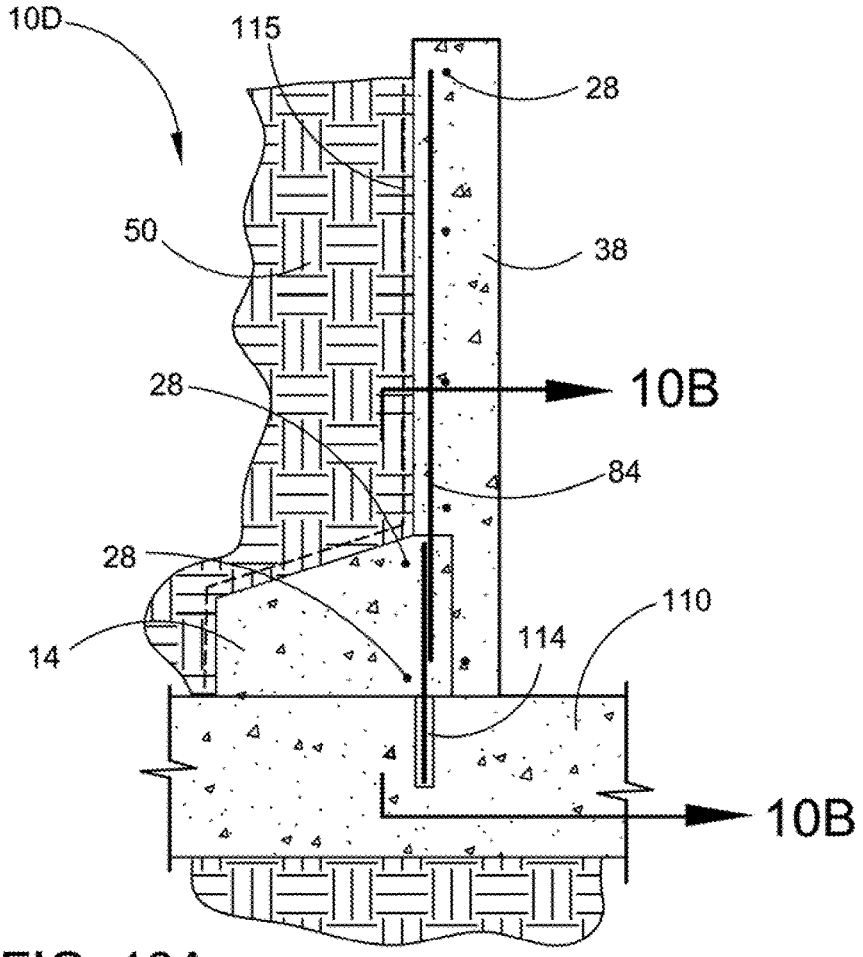
FIG. 10A depicts a cross section through the Pre-cast Decorative Retaining Wall in the form of Pre-cast Monument Wall or Pre-cast Concrete Fencing resting on an existing concrete deck surface, suitable to support the system.

FIG. 10A depicts a cross section through the Pre-cast Decorative Retaining Wall 10D in the form of Pre-cast Monument Wall or Pre-cast Concrete Fencing resting on an existing concrete deck surface 110. This configuration can be used to construct planter boxes and the like. Waterproof barrier 115 in the soil 50 side is used to allow water to run down to buttress support system 14 and out existing drains (not shown). Rebar 114 runs from the buttress support system 14 an into a drill hole within the existing podium deck 110, to secure the Pre-cast Monument Wall or Pre-cast Concrete Fencing resting on the existing concrete deck surface 110.

Figure 10B:
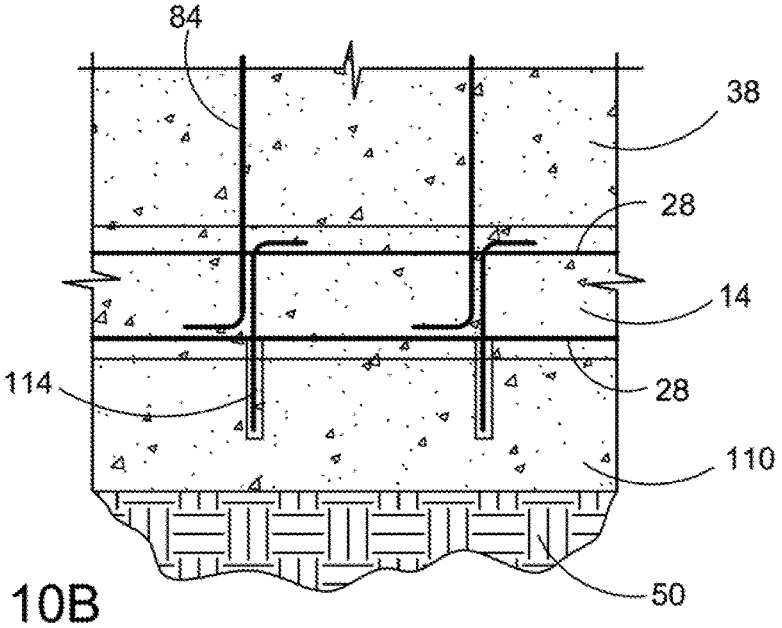
FIG. 10B depicts a front sectional view of FIG. 10A of the Pre-cast Decorative Retaining Wall in the form of Pre-cast Monument Wall or Pre-cast Concrete Fencing resting on an existing concrete deck surface, suitable to support the system.

FIG. 10B depicts a front sectional view of FIG. 10A of the Pre-cast Decorative Retaining Wall 10D in the form of Pre-cast Monument Wall or Pre-cast Concrete Fencing resting on an existing concrete deck surface 110. Rebar 84 is bent inside buttress support system 14, as is rebar 114 which extends down from buttress support system 14 into the existing podium deck 110 inside a drill hole, to secure the planer box or the like constructed in this fashion.

Figure 11:
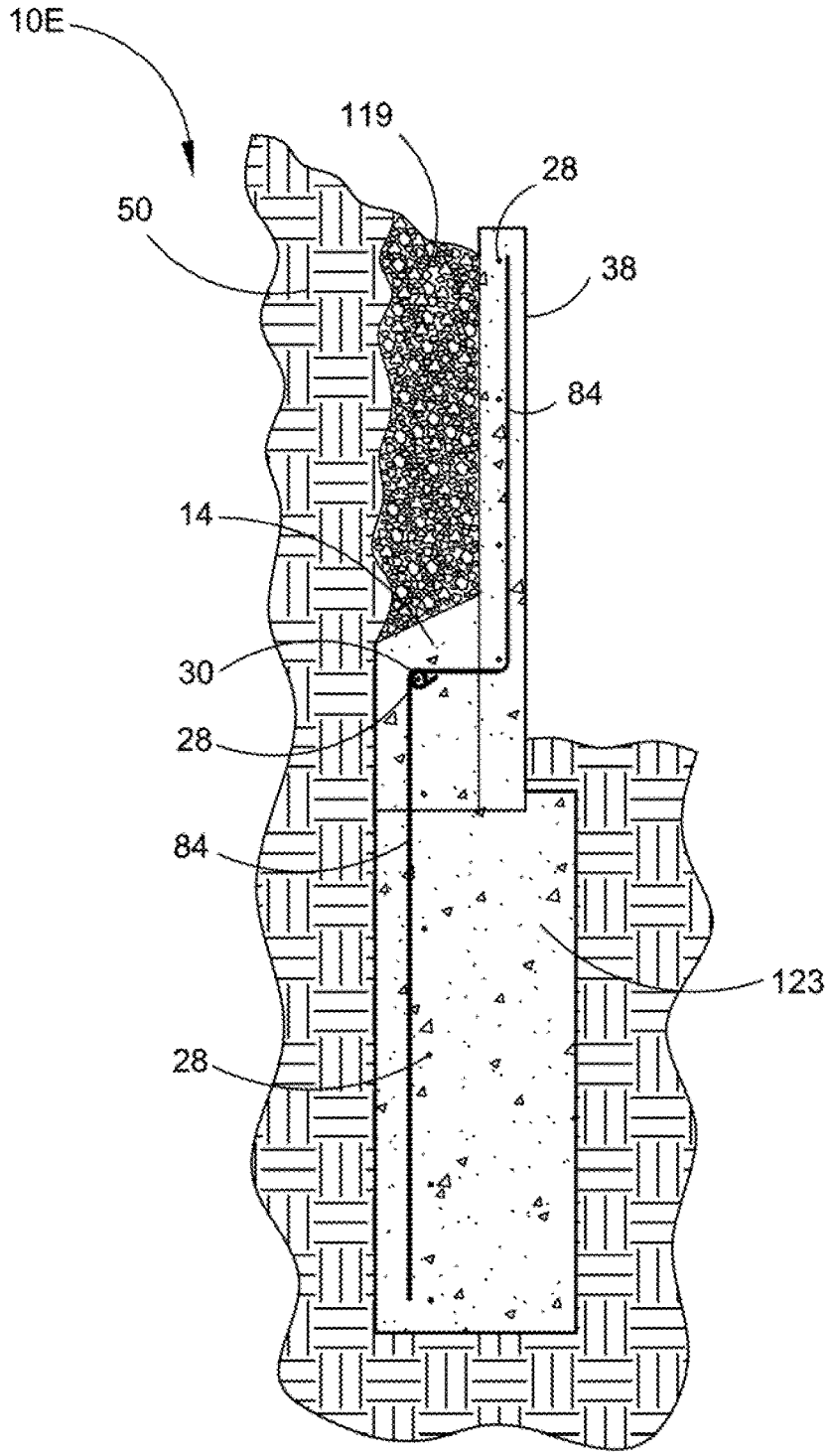
FIG. 11 depicts a cross section through the Pre-cast Decorative Retaining Wall in the form of Pre-cast Monument Wall or Pre-cast Concrete Fencing in a true cantilever configuration on piers or a continuous footing.

FIG. 11 depicts a cross section through the Pre-cast Decorative Retaining Wall 10E in the form of Pre-cast Monument Wall or Pre-cast Concrete Fencing in a true cantilever configuration on piers or a continuous footing 123. This configuration includes a backfill of gravel 119 behind the wall 38 and above the buttress support system 14 for efficient drainage.

Figure 12:
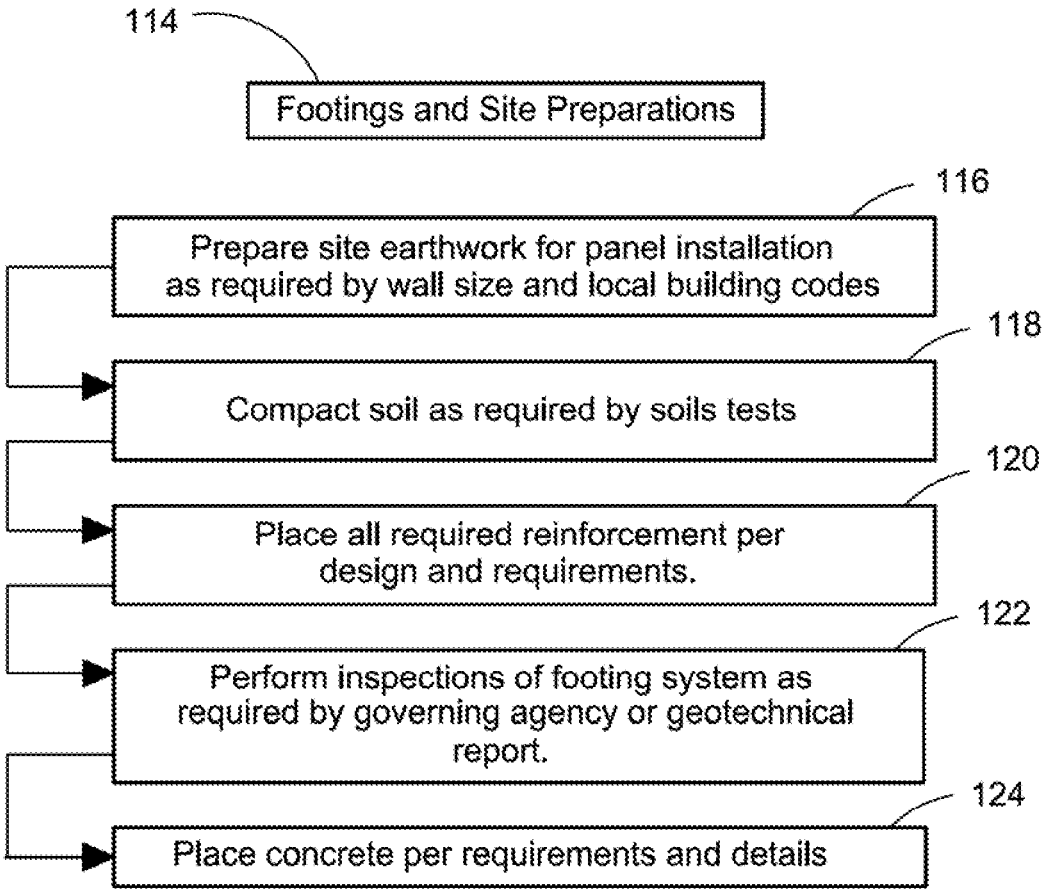
FIG. 12 depicts a block diagram describing steps of the footing site preparation.

FIG. 12 depicts a block diagram describing steps of the footing site preparation 114 where the first step 116 is to prepare the earthwork for panel installation as required by wall size and local building codes. The second step 118 is to compact the soil as required by the soils tests. The third step 120 is to place the required reinforcement per the design requirements. The fourth step 122 is to perform the inspections of the footing system as required by governing agency or geotechnical report. The fifth step 124 is to place the concrete per the requirements and details.

Figure 13:
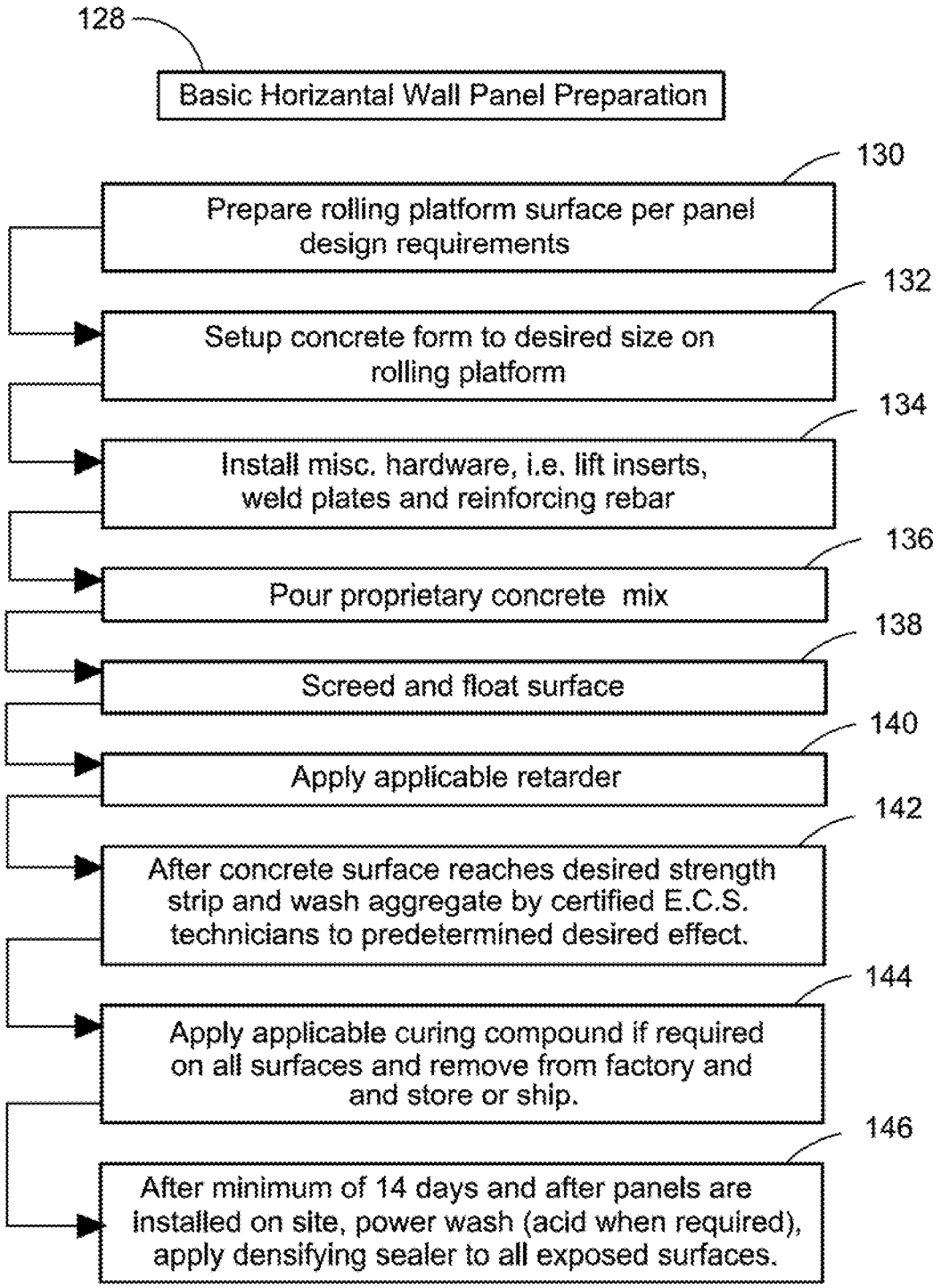
FIG. 13 depicts a block diagram describing steps of the basic horizontal wall panel preparation on a rolling platform.

FIG. 13 depicts a block diagram describing steps, of the basic horizontal wall panel preparation 128 where the first step 130 is to prepare the reflection surface per panel design requirements. The second step 132 is to setup concrete forms to the desired size on the reflection surface. The third step 134 is to install the miscellaneous hardware i.e. lift inserts weld plates and reinforcing rebar. The fourth step 136 is to pour proprietary concrete mix. The fifth step 138 is to screed and float the surface. The sixth step 140 is to apply the applicable retarder. The seventh step 142 is after the concrete surface reaches desired strength strip and wash aggregate by certified ECS technicians to predetermined desired effect. The eighth step 144 is to apply applicable cluing compound if required on all surfaces and remove from factory and store or ship. The ninth step 146 is after a minimum of 14 days and after the panels are installed on site, power wash (acid when required) apply densifying sealer to all exposed surfaces.

Figure 14A:
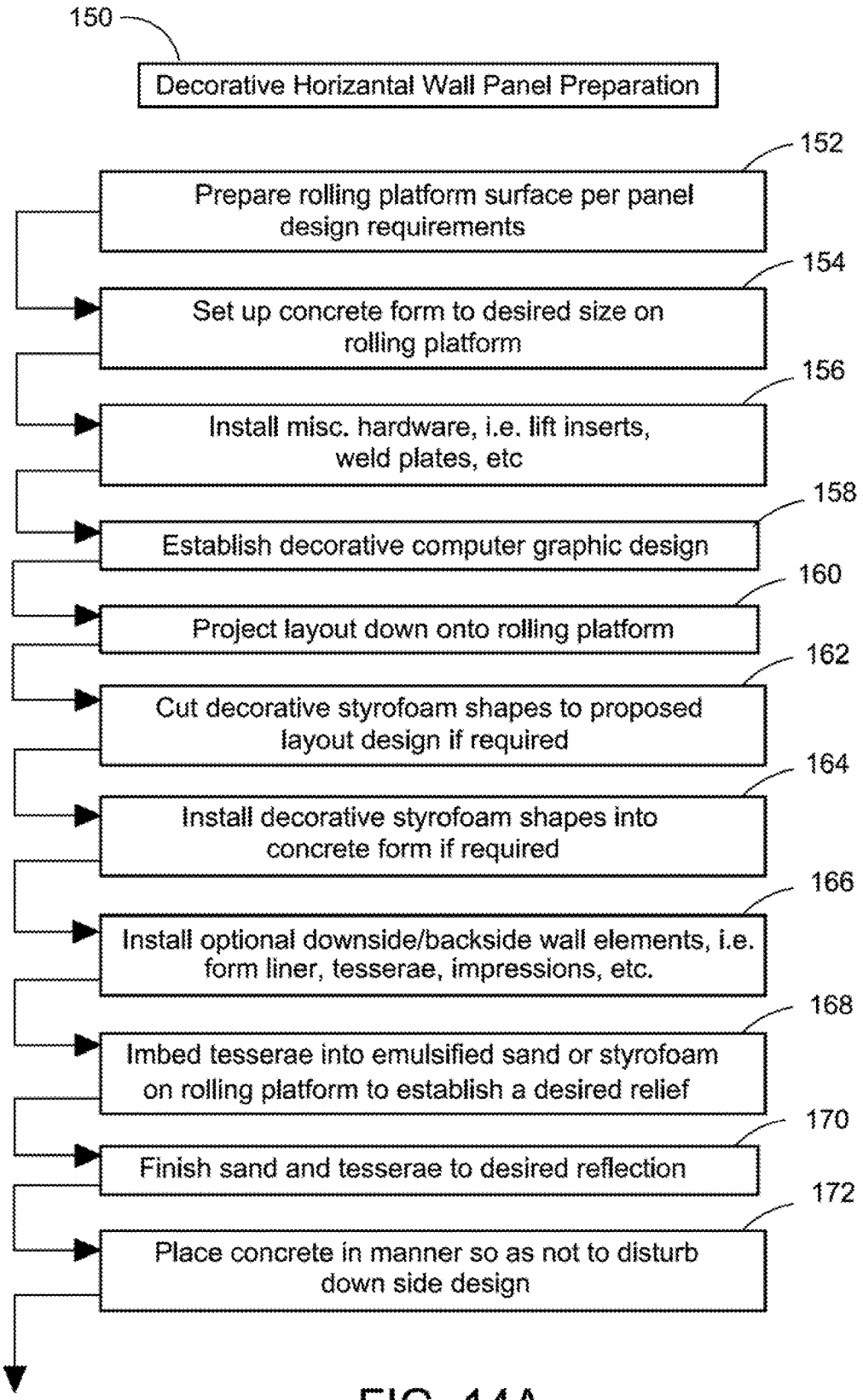
FIG. 14A depicts a block diagram describing steps of the decorative horizontal wall panel preparation.

FIG. 14A depicts a block diagram describing steps of the decorative horizontal wall panel preparation 150 where the first step 152 is to prepare the reflection surface per panel design requirements. The second step 154 is to set up concrete forms to the desired size on the reflection surface. The third step 156 is to install miscellaneous hardware i.e. lift inserts weld plates, etc. The fourth step 158 is to establish decorative computer graphic design. The fifth step 160 is to project layout down onto reflection surface. The sixth step 162 is to cut decorative Styrofoam shapes to proposed layout design if required. The seventh step 164 is to install Styrofoam shapes into concrete form if required. The eighth step 166 is to install optional downside/backside wall elements i.e. form liner, tesserae, impressions, etc. The ninth step 168 is to imbed tesserae into emulsified sand or Styrofoam on the reflection surface to establish desired relief. The tenth step 170 is to finish emulsified sand and tesserae to desired reflection. The eleventh step 172 is to place or implant reinforcing and accessory decorative components so as not to interfere with decorative features on either side. In lieu of Styrofoam, other suitable and like materials made be used for this decorating process.

Figure 14B:
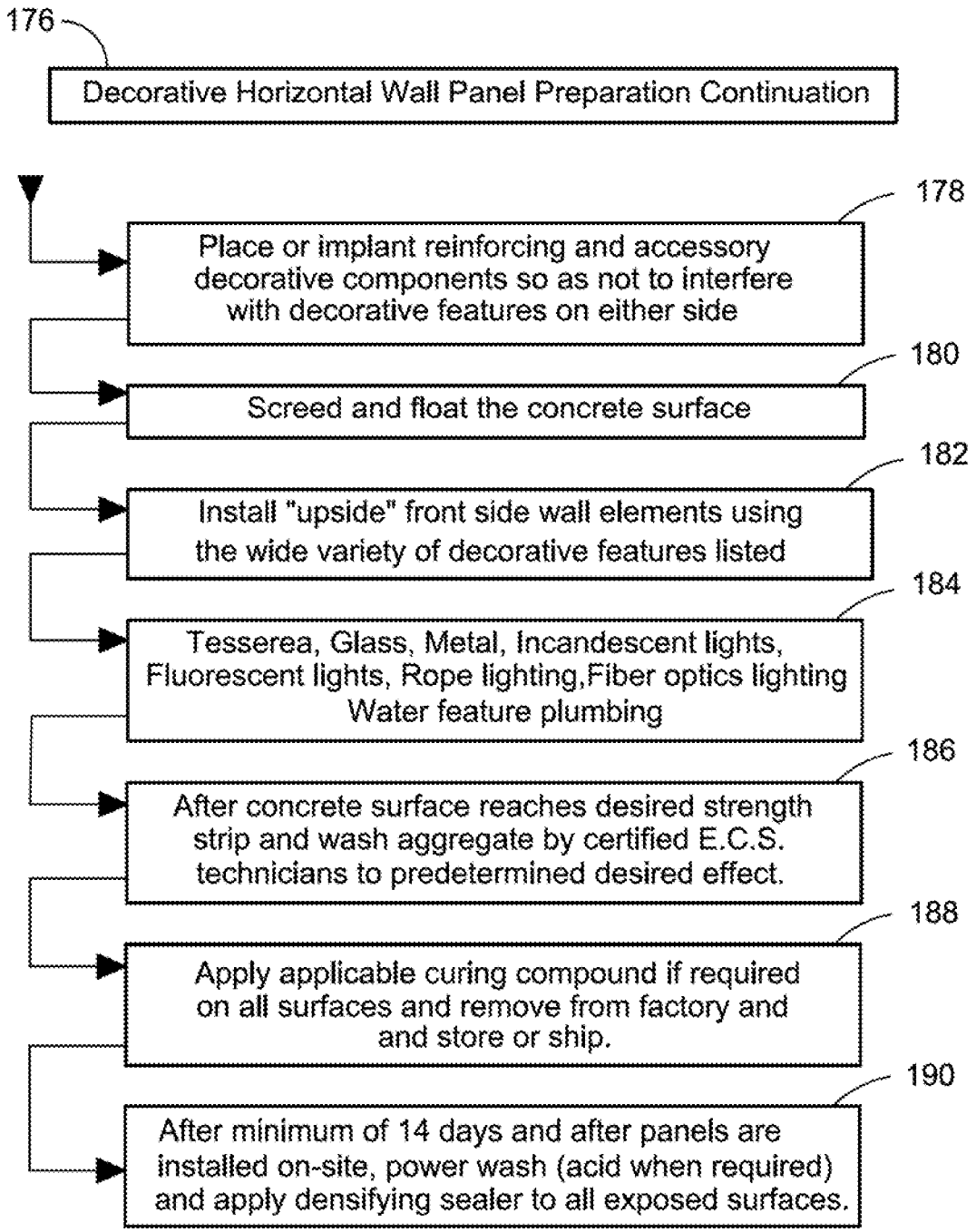
FIG. 14B depicts a block diagram describing steps of the continuation of the decorative horizontal wall panel preparation.

FIG. 14B depicts a block diagram describing steps of the continuation of the decorative horizontal wall panel preparation 176 where the twelfth step 178 is to place concrete in a manner so as not to disturb down side design. The thirteenth step 180 is to screed and float the concrete surface. The fourteenth step 182 is to install "upside" front side wall elements using the wide variety of decorative features listed. The fifteenth step 184 is to install tesserae, glass, metal, incandescent lights, fluorescent lights, rope lighting, fiber optic lighting and water feature plumbing. The sixteenth step 186 is after concrete surface reaches desired strength strip and wash aggregate by certified E.S.C. technician to, predetermined desired effect. The seventeenth step 188 is to apply applicable curing compound if required on all surfaces and remove from factory and store or ship. The eighteenth step 190 after a minimum of 14 days and after panels are installed on site, power wash (acid when required) and apply densifying sealer to all exposed surfaces. It should be emphasized that following this method result in substantial time savings over conventional retaining wall installation methods and construction techniques.

Figure 15:
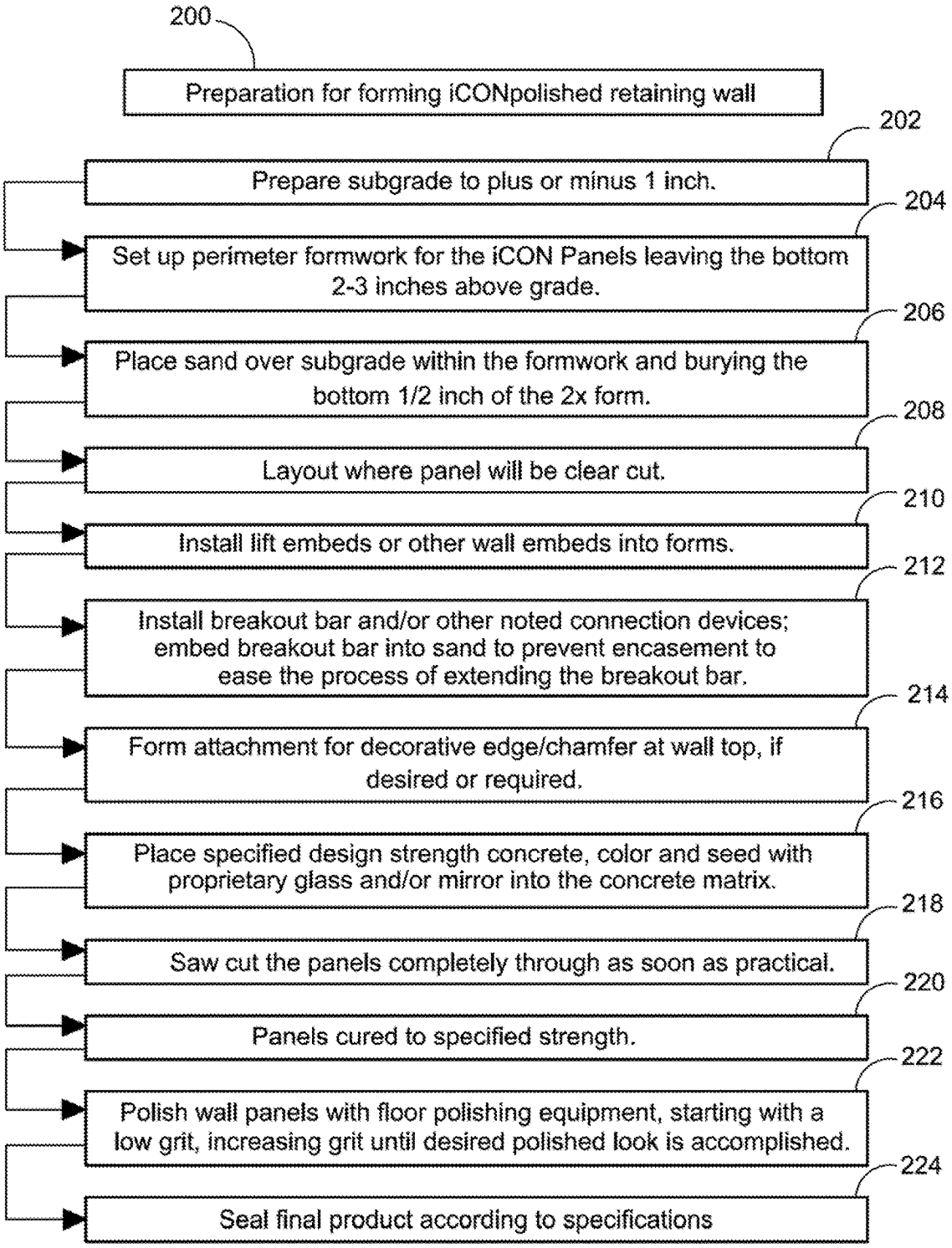
FIG. 15 depicts a block diagram describing the method steps of preparation for forming polished retaining wall pre-cast wall panels, or any plain or decorative pre-cast wall panel.

FIG. 15 depicts a block diagram describing the method stops of preparation for forming polished retaining wall pre-cast wall panels 200. The preparation for forming and polishing retaining wall pre-cast wall panels 200 includes the steps of:

Step 202—prepare subgrade to plus or minus 1 inch;

Step 204—set up perimeter formwork for the panels leaving the bottom 2-3 inches above grade;

Step 206—place sand over subgrade within the formwork and burying the bottom ½ inch of the 2× form;

Step 208—layout where panel will be clear cut;

Step 210—install lift embeds or other wall embeds into forms;

Step 212—install breakout bar and/or other noted connection devices; embed breakout bar into sand to prevent encasement to ease the process of extending the breakout bar;

Step 214—form attachment for decorative edge/chamfer at wall top, if desired or required;

Step 216—place specified design strength concrete, color and seed with proprietary glass and/or mirror into concrete matrix;

Step 218—saw cut the panels completely through as soon as practical;

Step 220—panels cure to specific strength;

Step 222—polish wall panels with floor polishing equipment, starting with a low grit, increasing grit until desired polished look is accomplished;

Step 224—seal final product according to specifications.

The resulting pre-cast continuous and horizontal retaining wall pre-cast wall panels are cast on-site and can be subsequently polished using floor polishing equipment until a desired granite polished look is accomplished, to result in a pre-cast wall panel having a finished granite look.

Figure 16:
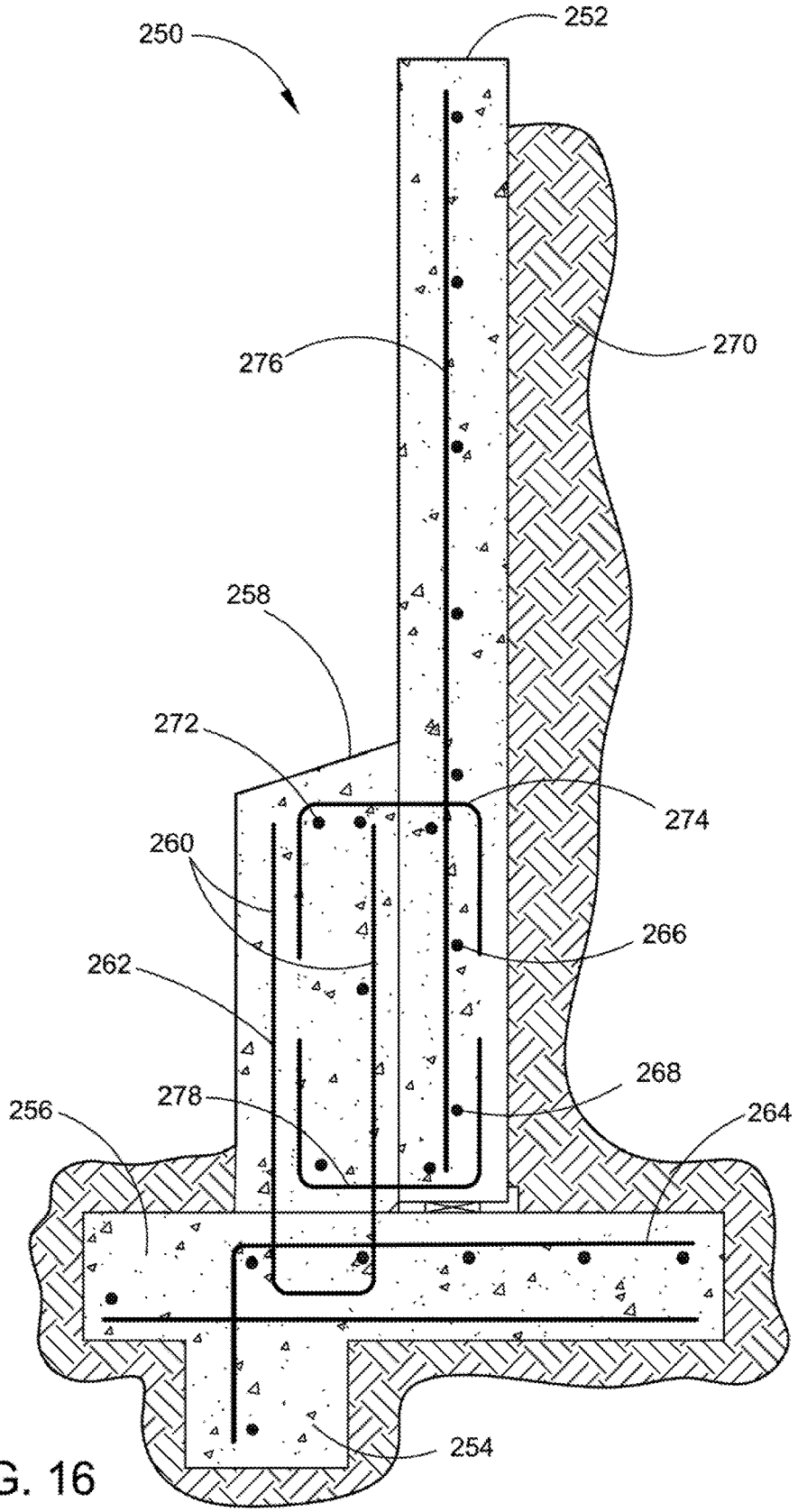
FIG. 16 depicts the configuration of the reinforcement elements within the pre-cast wall panel, buttress support structure and footing with key, where the buttress is on the exposed wall side not the backfill soil side, illustrating a multi-directional wall configuration that can support soil or other forces in either direction.

FIG. 16 depicts the configuration 250 of the reinforcement elements within the pre-cast wall panel, buttress support structure and footing with key, where the buttress is on the exposed wall side not the backfill soil side to restrain soil 270 or other non-soil related forces, such as seismic, grains, liquids, etc. Here, the pre-cast wall panel 252 has both vertical embedded reinforcement elements 276 and horizontal embedded reinforcement elements 266 and 268. The pre-cast wall panel 252 is placed on the footing member 256 which includes embedded reinforcement elements 264 and an optional key 254 (which also may have embedded reinforcement elements placed therein). Buttress support structure 258 includes vertical embedded reinforcement elements 260 and 262 which extend down into footing member 256. Buttress support structure includes horizontal embedded reinforcement elements 272.

Extending between wall panel 252 and buttress support structure 258 are one or more horizontal tie bar embedded reinforcement elements 274 located at the upper section of the wall panel/buttress and horizontal embedded reinforcement elements 278 located at the lower section of the buttress/wall panel. In this way the pre-cast continuous and horizontal retaining wall three-component system includes a pre-cast wall panel having an upper and lower section, and a buttress support structure having an upper and lower section and embedded reinforcement elements, like 274, are extended from the pre-cast wall panel upper section to the buttress support structure upper section, and further includes reinforcement elements extending between the pre-cast wall panel lower section to the buttress support structure lower section, like 278, thereby resulting in a double moment arm allowing for restraint in two opposite moment directions.

Figure 17B:
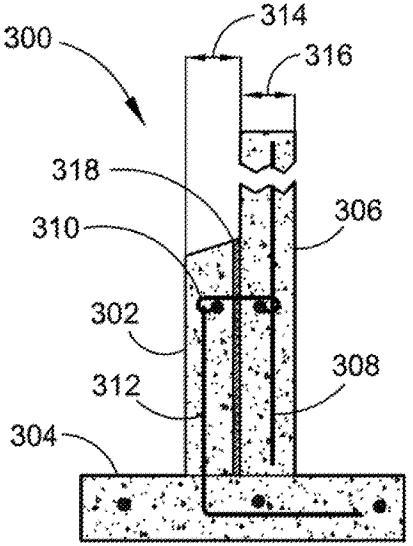
FIG. 17B depicts an installation and reinforcement method where the pre-cast wall panel is adhered to the buttress support structure using a prepared surface and bonding agent, where the buttress and footing are placed prior to the erection of the pre-cast wall panel and the buttress is placed with the bonding agent/prepared surface where by panel and buttress become a singular monolithic structure.
Figure 17A:
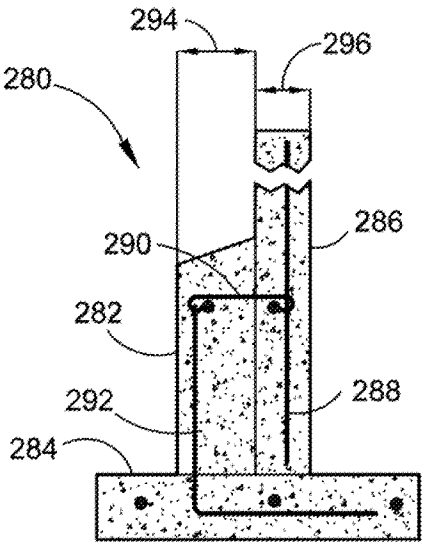
FIG. 17A depicts a typical installation and reinforcement of a three-component wall system, where the buttress is placed after erection of the pre-cast wall panel on the footing.

FIG. 17A depicts a typical installation 280 and reinforcement of a three-component wall system, where the buttress is placed after erection of the pre-cast wall panel on the footing and then grouted. As shown, wall panel 286, having a width of 296, includes embedded vertical reinforcement element 288 and is placed on footing member 284. Buttress support structure 282 also has embedded vertical reinforcement element 292 and is placed on footing member 284 wherein embedded vertical reinforcement element 292 extends down into and is embedded in footing member 284. Tie bar 290 extends from all panel 286 into buttress 292 connecting vertical reinforcement element 288 and 292. In this example, concrete or grout is filled into the surface gaps between the footing and the wall panel and the buttress and the wall panel. When this method of construction is utilized, the width 294 of the buttress 282 has to be thicker, 15 inches on average, thereby costing more in concrete material costs as well as labor costs.

FIG. 17B depicts an installation 300 and reinforcement method where the pre-cast wall panel is adhered to the buttress support structure 302 using a bonding agent 318, where the footing is placed prior to the erection of the pre-cast wall panel. As shown, wall panel 306, having a width 316, includes embedded vertical reinforcement element 308 and is placed on footing member 304. Buttress support structure 302 also has embedded vertical reinforcement element 312 and is placed in footing member 304 wherein embedded vertical reinforcement element 312 extends down into and is embedded in footing member 304. Tie bar 310 extends from wall panel 306 into buttress 302 connecting vertical reinforcement element 308 and 312. In this example, a bonding agent and/or prepared surface 318 is used to connect, adhere, and secure the buttress 302 to the wall panel 306. When this method of construction is utilized, the width 314 of the buttress 302 can be thinner, 9 inches on average, resulting in a significant savings in concrete used to place the buttress 302 as compared to the method described in FIG. 17A. Thus, as an option to the independent panel and buttress, care and preparation can be used to prepare a bondable surface at the panel area directly adjacent to the buttress. Then, the plurality of reinforcement elements embedded within the pre-cast wall panel and partially exposed externally to the pre-cast wall panel, and the plurality of reinforcement elements embedded within the footing member and partially exposed externally to the footing member, are embedded into the concrete buttress support structure by generating an adhesive accepting prepared surface using a bonding agent to connect, adhere and secure said buttress support structure to said pre-cast wall panel. This creates a monolithic base in lieu of an independent wall and buttress, which would reduce the amount of buttress concrete required.

Figure 18C:
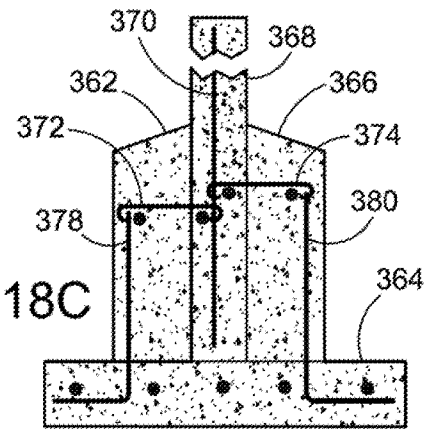
FIG. 18C depicts an installation and reinforcement of a double buttress support structure on both sides, to resist any forces from either side or both sides of the system or for any freestanding wall construction.
Figure 18B:
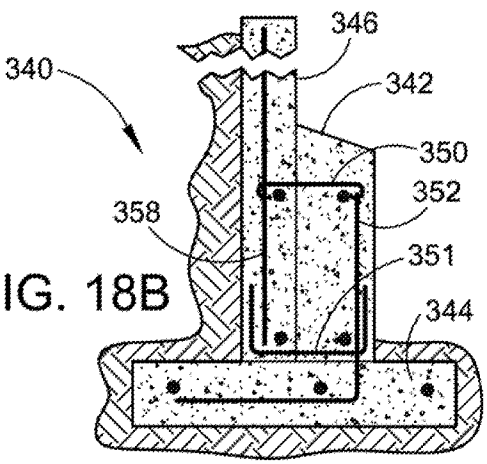
FIG. 18B depicts an installation and reinforcement of the buttress support structure on the exposed wall side.
Figure 18A:
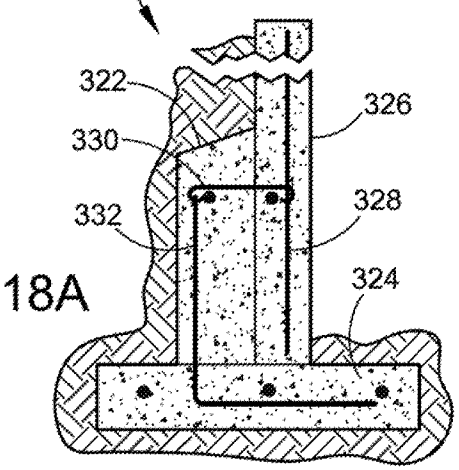
FIG. 18A depicts an installation and reinforcement of the buttress support structure on the backfill soil side.

FIG. 18A depicts an installation 320 and reinforcement of the buttress support structure on the backfill soil side. Here, wall panel 326 and buttress support structure 322 are placed on footing member 324. Vertical reinforcement elements 328 and 332 run within and are embedded in wall panel 326 and buttress 322, respectively. Tie bar 330 connects vertical reinforcement elements 328 and 332. In this example, the buttress support structure 322 is placed on the soil backfill side of the resulting retaining wall.

FIG. 18B depicts an installation and reinforcement of the buttress support structure on the exposed wall side 340. Here, wall panel 346 and buttress support structure 342 are placed on footing member 344. Vertical reinforcement elements 352 and 358 run within and are embedded in wall panel 346 and buttress 342, respectively. Tie bars 350 on the top and 351 on the bottom connect vertical reinforcement elements 358 and 352. In this example, the buttress support structure 342 is placed on the exposed wall side of the resulting retaining wall, for a reversed moment arm, double moment arm, or a two-way resisting moment arm wall structure.

FIG. 18C depicts an installation and reinforcement of a double buttress support structure on both sides 360, namely, both the backfill soil side and the exposed wall side. Here, wall panel 368 is sandwiched between two buttress support structures 362 and 366, all of which are placed on footing member 364. Multiple vertical reinforcement elements 370 and 378 and 380 run within and are embedded within wall panel 368 (370) and buttresses 362 (378) and 366 (380), respectively. Tie bars 372 and 374 connect vertical reinforcement elements 370 to 378 and 380. In this example, two buttress support structures 362 and 366 are placed on the soil backfill side and the exposed wall side of the resulting retaining wall, representing a double buttress construction configuration. Therefore, another advantage of the present inventive system is that the buttress can be placed on either side of the wall panel. This would relocate the tension connection to the bottom of the buttress for a reverse tension and moment condition. Having tension connectors at the bottom of the buttress, and having buttress to footing reinforcement at each face, the present system can resist forces from both directions front and back.

Figure 19A:
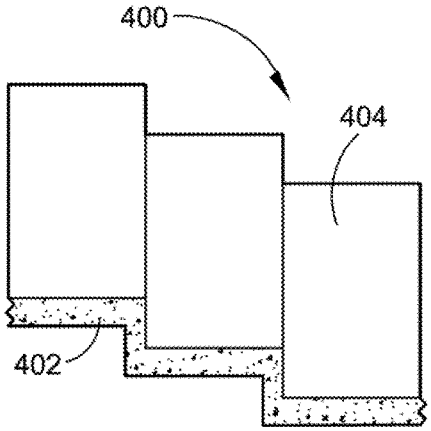
FIG. 19A depicts an installation of a wall using a footing constructed in a step-wise method, and placement of uniformly rectangular pre-cast wall panels on the stepped footing.

FIG. 19A depicts an installation 400 of a wall using a footing constructed in a step-wise method 402, and placement of uniformly rectangular pre-cast wall panels 404 on the stepped footing 402.

Figure 19B:
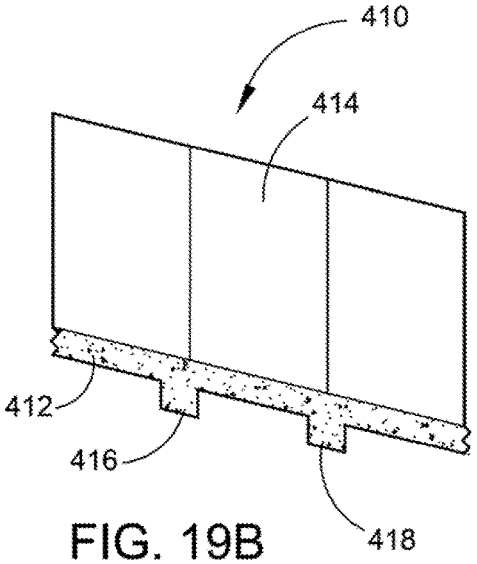
FIG. 19B depicts an installation of a wall using a slopped footing, and placement of top and bottom angled pre-cast wall panels on the footing on a steep grade.

FIG. 19B depicts an installation 410 of a wall using a slopped footing 412, and placement of top and bottom angled cut pre-cast wall panels 414 on the slopped footing 412. If the slope approaches 20-30% or greater grade, then optionally one or more keys 416 and 418 can be placed on the slopped footing member 412.

Figure 19C:
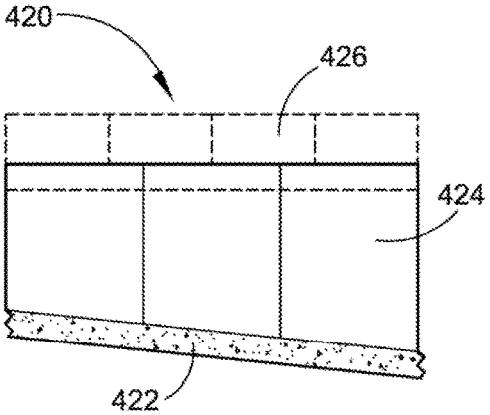
FIG. 19C depicts an installation of a wall using a slopped footing for acceptable grades, and placement of bottom angled pre-cast wall panels on the slopped footing, where the top of the pre-cast wall panels is level at one specified height.

FIG. 19C depicts an installation 420 of a wall using a slopped footing 422, and placement of bottom angled cut pre-cast wall panels 424 on the slopped footing 422, where the top 426 of the pre-cast wall panels is level, or can be leveled, at one specified height. Another advantage of the present invention is that the wall panels do not require a stepped footing on slopes. This saves considerable time and money. Unlike modular masonry and cast in place formwork, the bottom of the pre-cast panels can be manufactured to the same shape or slope of the foundation. The top of the panels can also be shaped to match the retained grades or simply give t any shape, geometric or curvilinear, for an enhanced artistic effect and increased value.

Figure 19D:
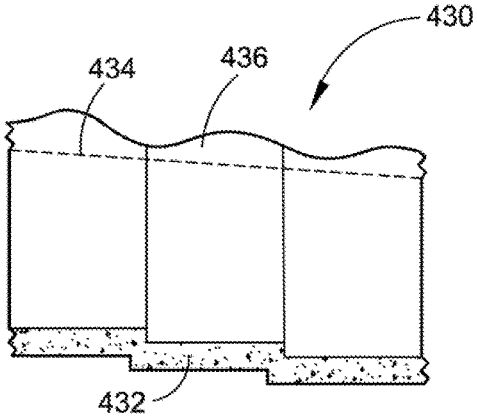
FIG. 19D depicts an installation of a wall using a stepped footing, and placement of uniformly rectangular pre-cast wall panels on the stepped footing, where the top of the pre-cast wall panels is decorative at a varying height.

FIG. 19D depicts an installation 430 of a wall using a stepped footing 432, and placement of uniformly rectangular pre-cast wall panels 434 on the stepped footing, where the top of the pre-cast wall panels 436 is decorative at a level or varying height.

Figure 20A:
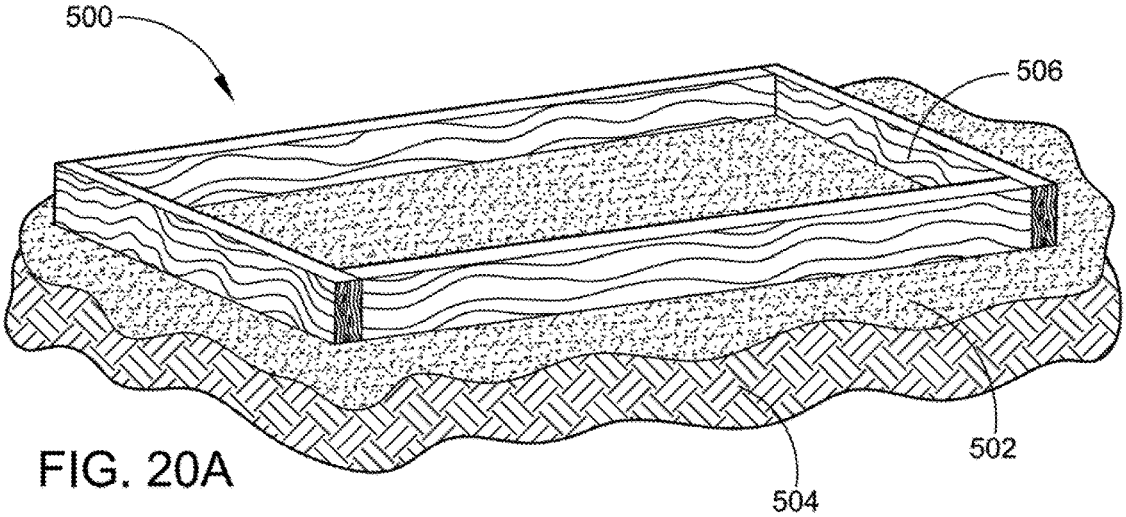
FIG. 20A depicts a form for casting pre-cast panels on site, where the form is constructed on a subgrade and sand base, without the use of a casting slab or waste slab.

FIG. 20A depicts a method 500 for casting pre-cast panels on site, where the form 506 (here shown as a wooden form) is constructed on a subgrade 504 and sand base 502, without the use of a casting slab or waste slab. This method of casting in wooden forms 506 and on a subgrade/sand base significantly saves time and costs as opposed to pouring a waste slab, using the waste slab and then removing the waste slab after the casting process.

Figures 20B, 20C, 20D:
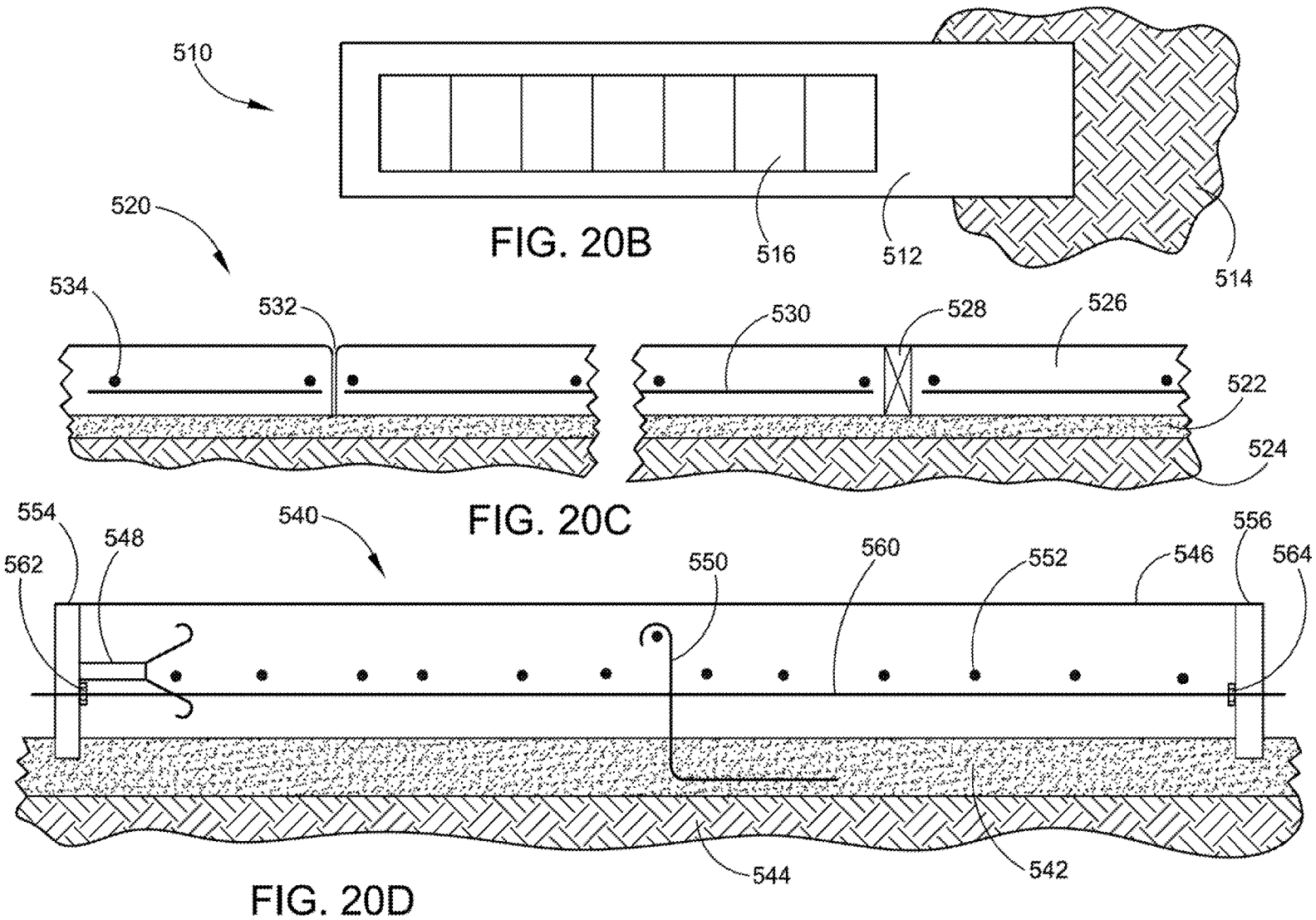
FIG. 20B depicts a method for forming pre-cast wall panels on site by pouring a long "sidewalk" structure, then cutting the pre-cast wall panels into sizes and lengths as required, or having formwork at panel joints/edges, and the top and bottom of this formwork can be shaped in any form pattern.
FIG. 20C depicts a method for casting pre-cast panels on site, where the form is constructed on a subgrade and sand base, and where the wall edges may be configured as rounded edges or sharp edges as required.
FIG. 20D depicts a method for casting pre-cast panels on site, where the form is constructed on a subgrade and sand base, and where the pre-cast wall panel includes embedded reinforcement elements, embedded connector elements and pre-tensioned or post-tensioned reinforcement elements.

FIG. 20B depicts a method 510 for forming multiple pre-cast wall panels on site by pouring a long "sidewalk" structure 516 of multiple uncut wall panels, then cutting the pre-cast wall panels into sizes and lengths as required. This method can be accomplished on a subgrade 514 and sand base 512, or a waste slab poured and leveled on a subgrade. Additionally, multiple interior forms can also be used at required sizes at the cut lines as diagrammed in the long "sidewalk" structure as shown in FIG. 20B.

FIG. 20C depicts a method 520 for casting multiple pre-cast panels 526 on site, where the form is constructed on a subgrade 524 and sand base 522, and where the wall edges may be configured as rounded edges 532 or sharp edges using a squared form 528, as required. Also shown here are the numerous vertical 534 and horizontal 530 embedded reinforcement elements which are placed before pouring the pre-cast wall panel 526. As a result, wall panels can be cast with rounded edges or sharp squared off edges. An advantage of the present invention is that this multiple horizontal casting method allows for the ability to place long areas of panels without the requirement of individual pieces and on installing construction and control joints. These extended length of panels can be cut to size and have expansion control requirements met with ease.

FIG. 20B depicts a method 540 for casting pre-cast panels 546 on site, where the form 554 and 556 is constructed on a subgrade 544 and sand base 542, and where the pre-cast wall panel 546 includes embedded installation lift wall embeds 548 and reinforcement/connector embeds 550, as well as vertical and/or horizontal reinforcement elements 552, embedded connector elements 548 and optionally pre-tensioned or post-tensioned reinforcement elements 560. Pre-tensioned or post-tensioned reinforcement elements 560 would span the length of the wall panel and be secured using tightening connections 562 and 564 on both ends of the panel 546 inside forms 554 and 556, respectively.

Figure 21:
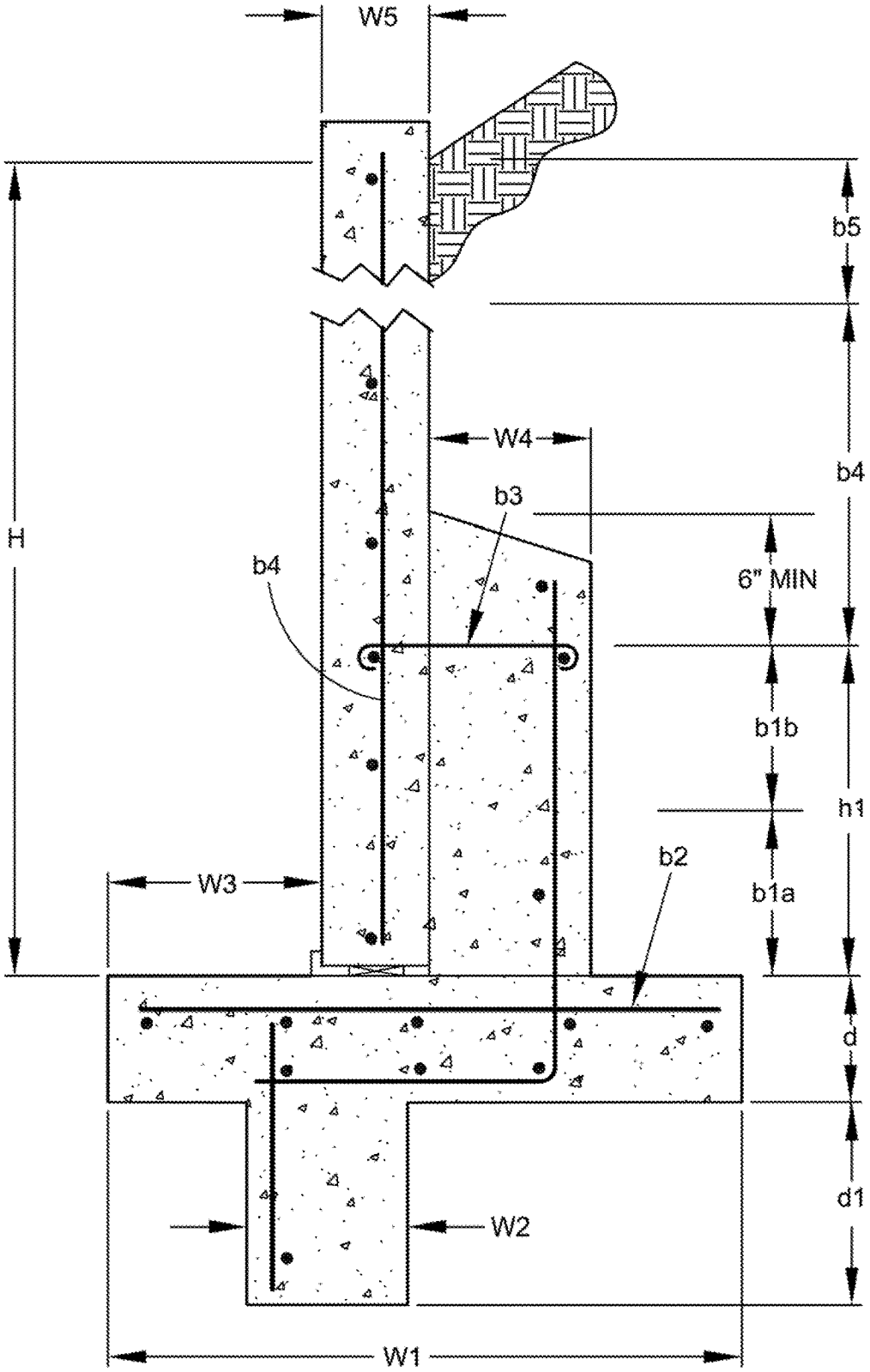
FIG. 21 depicts a typical retaining wall installation showing the various specification length, width, thickness and height of the components of the wall for constructing walls of varying height, thickness and length per required moment restraint specifications.

FIG. 21 depicts a typical wall installation showing the various specification length, width, thickness and height of the components of the wall for constructing walls of varying height, thickness and length per required moment restraint specifications. A retaining wall is defined as any wall which resists forces from any source or medium, including but not limited to wind, seismic, water, grains, soils and soil surcharges. The present invention provides for a process that creates a concrete mechanism, namely, a buttress support structure, that can connect two separate components, a wall and a footing, in a fashion that allows for restraint in two opposite directions as well as vertically and horizontally.

The enumerated specification dimensions and sizes are outlined here in FIG. 21. These are defined in detail and numerical ranges in Table 1 found in FIG. 22 and described in further detail below.

Concrete is generally thought of as a good material mostly in compression type constructions. The present invention utilizes this concrete retaining wall design to create and take advantage of tensile restraint. The key is the concrete buttress which utilizes the development lengths in concrete encapsulated reinforcing elements situated in specific engineered locations throughout the installation. Another advantage is that this connecting buttress is reinforced concrete which can be buried without concern for corrosion and especially rust, as is the case with mechanical connections commonly in use today.

FIG. 22 depicts TABLE 1 including the various retaining wall schedule showing the various specification length, width, thickness and height of the components of the wall for constructing walls of varying height, thickness and length per moment restraint specifications. The definitions of the TABLE 1 headings in FIG. 22 are as follows:

H=height of retaining
W1=total footing width
W2=width of key
W3=length of footing toe
W4=width of buttress
W5=width of pre-cast panel
d=footing thickness
d1=depth of key
b1*a*=buttress base reinforcement
b1*b*=buttress top reinforcement
b2=top of footing reinforcement
b3=connector size/spacing tension tie bar
b4=bottom of panel reinforcing
b5=top of pre-cast panel reinforcing
h1=true effective buttress height

EXAMPLE 1

For example, based on this Retaining Wall Schedule (2:1 backfill—with 4"-6" heels (maximum))—cut, as seen in TABLE 1 of FIG. 22, for a height of retaining (H) of 10'-1" to 12' the total footing width (W1) would be 6'9", the with of key (W2) would be 12", the length of footing toe (W3) would be 3'3", the width of buttress (W4) would be 15", the width of pre-cast panel (W5) would be 7¼", the footing thickness (d) would be 18", the depth of key (d1) would be 18", the buttress base reinforcement (b1*a*) would be #7 rebar at 11", the buttress top reinforcement (b1*b*) would be #7 rebar at 11", the top of footing reinforcement (b2) would be #6 rebar at 16" or #7 rebar at 22", the connector size/spacing (b3) would be #44 rebar at 12", the bottom of panel reinforcing (b4) would be #5 rebar at 8", the top of pre-cast panel reinforcing (b5) would be #5 rebar at 16" at 5'-0", and the true effective buttress height (h1) would be 4'-9".

The Pre-cast Decorative Retaining Wall 10A, 10B, 10C, 10D and 10E shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing the Pre-cast Decorative Retaining Wall 10A. 10B, 10C, 10D and 10E in accordance with the spirit of this disclosure, and such changes, alternations and modifications as would occur to those skilled in the art are considered to be within the scope of this design as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to an novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one, or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more, embodiments or that one or more embodiments, necessarily include logic for deciding, with or without user intuit or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of, the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the US Patent and Trademark Office and the public generally, and especially the scientists, engineers and practitioners in the art who are familiar with patent or legal terms and phraseology, to determine quickly from a cursory inspection the nature and essence of the technical disclosure of the application, which is measured by the claims, nor is it intended to be limiting as to the scope of the invention in any way.

We claim:

1. A pre-cast continuous and horizontal retaining wall three-component system comprising:

a) a first system component comprising one or more continuous and horizontal placed concrete footing members including a concrete wall accepting portion, a buttress support structure accepting portion and including a key portion, wherein said footing member is capable of supporting a pre-cast concrete wall and a buttress support structure placed thereon, and having a plurality of embedded reinforcement elements therein;

b) a second system component comprising one or more pre-cast concrete walls having a front wall surface and a wall back side, constructed by casting on-site on a horizontal surface, and including a plurality of embedded reinforcement elements within said pre-cast concrete walls, wherein said pre-cast concrete wall is mounted on said one or more continuous and horizontal placed concrete footing members;

c) and further wherein said plurality of embedded reinforcement elements embedded within said footing are exposed outside of said footing members and said plurality of embedded reinforcement elements embedded within said pre-cast wall panels are exposed outside of said pre-cast wall panel, and including tying together said exposed embedded reinforcement elements wherein said footing reinforcement elements are attached to said pre-cast wall panel reinforcement elements extending therebetween, following placement of said pre-cast wall panel on said footing member; and d) a third system component comprising one or more continuous and horizontal buttress support structures placed on top of said one or more continuous and horizontal footing members and placed adjacent to said pre-cast wall panel, thereby connecting said pre-cast wall panel to said footing member, by embedding said tied together exposed plurality of reinforcement elements, extending therebetween within said placed buttress support structure.

2. The pre-cast continuous and horizontal retaining wall three-component system according to claim 1, wherein said pre-cast wall panel has an upper and lower section, and said buttress support structure has an upper and lower section and embedded reinforcement elements are extended from said pre-cast wall panel upper section to said buttress support structure upper section and further wherein reinforcement elements extend between said pre-cast wall panel lower section to said buttress support structure lower section;

thereby resulting in a double moment arm allowing for restraint in two opposite moment directions.

3. The pre-cast continuous and horizontal retaining wall three-component system according to claim 1, wherein said pre-cast wall panel includes a soil backfill side and an exposed wall side, and further wherein said buttress support structure is placed on the soil backfill side of said pre-cast wall panel.

4. The pre-cast continuous and horizontal retaining wall three-component system according to claim 1, wherein said pre-cast wall panel includes a soil backfill side and an exposed wall side, and further wherein said buttress support structure is placed on the exposed wall side of said pre-cast wall panel.

5. The pre-cast continuous and horizontal retaining wall three-component system according to claim 1, wherein said pre-cast wall panel includes a soil backfill side and an exposed wall side, and further wherein said buttress support structure is placed on both the exposed wall side and the backfill soil side of said pre-cast wall panel.

6. The pre-cast continuous and horizontal retaining wall three-component system according to claim 1, wherein said plurality of reinforcement elements embedded within said pre-cast wall panel and partially exposed externally to said pre-cast wall panel, and said plurality of reinforcement elements embedded within said footing member and partially exposed externally to said footing member, are embedded into said concrete buttress support structure by using shotcrete concrete spraying to form and place said buttress support structure, thereby protecting said plurality of reinforcement elements within concrete to prevent corrosion and subsequent weakening of said reinforcement elements.

7. The pre-cast continuous and horizontal retaining wall three-component system according to claim 1, wherein said plurality of reinforcement elements embedded within said pre-cast wall panel and partially exposed externally to said pre-cast wall panel, and said plurality of reinforcement elements embedded within said footing member and partially exposed externally to said footing member, are embedded into said concrete buttress support structure by generating an adhesive accepting prepared surface using a bonding agent to connect, adhere and secure said buttress support structure to said pre-cast wall panel.

8. The pre-cast continuous and horizontal retaining wall three-component system according to claim 1, wherein said pre-cast wall panel is cast on-site within forms placed on a horizontal surface of sand which is placed directly above a horizontal surface of leveled subgrade, including a subgrade of waste concrete.

9. The pre-cast continuous and horizontal retaining wall three-component system according to claim 1, wherein an extended multiple pre-cast wall panel sidewalk structure is cast on-site within forms placed on a horizontal surface of sand which is placed on a horizontal surface of leveled subgrade, including a subgrade of waste concrete, and further wherein said extended pre-cast wall panel sidewalk structure is cut into individual pre-cast wall panels for subsequent erection.

10. The pre-cast continuous and horizontal retaining wall three-component system according to claim 1, wherein said pre-cast wall panel includes pre-tensioned and post-tensioned cables embedded with said pre-cast wall panel when said pre-cast wall panel is cast on site within forms placed on a horizontal surface of sand which is placed on a horizontal surface of leveled subgrade, including a subgrade of waste concrete.

11. The pre-cast continuous and horizontal retaining wall three-component system according to claim 1, wherein said pre-cast wall panels are cast on-site and subsequently said pre-cast wall panels surfaces are finished by polishing using floor polishing equipment until a desired granite polished look is accomplished, to result in a pre-cast wall panel surface having a finished granite look.

12. The pre-cast continuous and horizontal retaining wall three-component system according to claim 1, wherein said footing member is placed as a slopped footing to follow the contour of the land said footing is placed upon.

13. The method for making a pre-cast continuous and horizontal retaining wall three-component system comprising the steps of:

a) providing a first system component comprising one or more continuous and horizontal placed concrete footing members including a concrete wall accepting portion, a buttress support structure accepting portion and including a key portion, wherein said footing member is capable of supporting a pre-cast concrete wall and a buttress support structure placed thereon, and having a plurality of embedded reinforcement elements therein;

b) providing a second system component comprising one or more pre-cast concrete walls having a front wall surface and a wall back side, constructed by casting on-site on a horizontal surface, and including a plurality of embedded reinforcement elements within said pre-cast concrete walls, wherein said pre-cast concrete wall is mounted on said one or more continuous and horizontal placed concrete footing members;

c) and further wherein said plurality of embedded reinforcement elements embedded within said footing are exposed outside of said footing members and said plurality of embedded reinforcement elements embedded within said pre-cast wall panels are exposed outside of said pre-cast wall panel, and including tying together said exposed embedded reinforcement elements wherein said footing reinforcement elements are attached to said pre-cast wall panel reinforcement elements extending therebetween, following placement of said pre-cast wall panel on said footing member; and d) providing a third system component comprising one or more continuous and horizontal buttress support structures placed on top of said one or more continuous and horizontal footing members and placed adjacent to said pre-cast wall panel, thereby connecting said pre-cast wall panel to said footing member, by embedding said tied together exposed plurality of reinforcement elements, extending therebetween within said placed buttress support structure.

14. The method of making a pre-cast continuous and horizontal retaining wall three-component system according to claim 13, wherein said pre-cast wall panel has an upper and lower section, and said buttress support structure has an upper and lower section and embedded reinforcement elements are extended from said pre-cast wall panel upper section to said buttress support structure upper section and further wherein reinforcement elements extend between said pre-cast wall panel lower section to said buttress support structure lower section;

thereby resulting in a double moment arm allowing for restraint in two opposite moment directions.

15. The method of making a pre-cast continuous and horizontal retaining wall three-component system according to claim 13, wherein said pre-cast wall panel includes a soil backfill side and an exposed wall side, and further wherein said buttress support structure is placed on the soil backfill side of said pre-cast wall panel.

16. The method of making a pre-cast continuous and horizontal retaining wall three-component system according to claim 13, wherein said pre-cast wall panel includes a soil backfill side and an exposed wall side, and further wherein said buttress support structure is placed on the exposed wall side of said pre-cast wall panel.

17. The method of making a pre-cast continuous and horizontal retaining wall three-component system according to claim 13, wherein said pre-cast wall panel includes a soil backfill side and an exposed wall side, and further wherein said buttress support structure is placed on both the exposed wall side and the backfill soil side of said pre-cast wall panel.

18. The method of making a pre-cast continuous and horizontal retaining wall three-component system according to claim 13, wherein said plurality of reinforcement elements embedded within said pre-cast wall panel and partially exposed externally to said pre-cast wall panel, and said plurality of reinforcement elements embedded within said footing member and partially exposed externally to said footing member, are embedded into said concrete buttress support structure by using shotcrete concrete spraying to form and place said buttress support structure, thereby protecting said plurality of reinforcement elements within concrete to prevent corrosion and subsequent weakening of said reinforcement elements.

19. The method of making a pre-cast continuous and horizontal retaining wall three-component system according to claim 13, wherein said plurality of reinforcement elements embedded within said pre-cast wall panel and partially exposed externally to said pre-cast wall panel, and said plurality of reinforcement elements embedded within said footing member and partially exposed externally to said footing member, are embedded into said concrete buttress support structure by generating an adhesive accepting prepared surface using a bonding agent to connect, adhere and secure said buttress support structure to said pre-cast wall panel.

20. The method of making a pre-cast continuous and horizontal retaining wall three-component system according to claim 13, wherein said pre-cast wall panel is cast on-site within forms placed on a horizontal surface of sand which is placed directly above a horizontal surface of leveled subgrade, including a subgrade of waste concrete.

21. The method of making a pre-cast continuous and horizontal retaining wall three-component system according to claim 13, wherein an extended multiple pre-cast wall panel sidewalk structure is cast on-site within forms placed on a horizontal surface of sand which is placed on a horizontal surface of leveled subgrade, including a subgrade of waste concrete, and further wherein said extended pre-cast wall panel sidewalk structure is cut into individual pre-cast wall panels for subsequent erection.

22. The method of making a pre-cast continuous and horizontal retaining wall three-component system according to claim 13, wherein said pre-cast wall panel includes pre-tensioned and post-tensioned cables embedded with said pre-cast wall panel when said pre-cast wall panel is cast on site within forms placed on a horizontal surface of sand which is placed on a horizontal surface of leveled subgrade, including a subgrade of waste concrete.

23. The method of making a pre-cast continuous and horizontal retaining wall three-component system according to claim 13, wherein said pre-cast wall panels are cast on-site and subsequently said pre-cast wall panels surfaces are finished by polishing using floor polishing equipment until a desired granite polished look is accomplished, to result in a pre-cast wall panel surface having a finished granite look.

24. The method of making a pre-cast continuous and horizontal retaining wall three-component system according to claim 13, wherein said footing member is placed as a slopped footing to follow the contour of the land said footing is placed upon.

* * * * *